US008413397B2

(12) United States Patent
Lacas et al.

(10) Patent No.: US 8,413,397 B2
(45) Date of Patent: Apr. 9, 2013

(54) ARTIFICIAL STONE

(75) Inventors: Marc-Andre Lacas, Laval (CA); Bertin Castonguay, Magog (CA); Robert Daoust, Boucherville (CA)

(73) Assignee: Oldcastle Building Products Canada Inc. (CA)

( * ) Notice: Subject to any disclaimer, the term of this patent is extended or adjusted under 35 U.S.C. 154(b) by 0 days.

(21) Appl. No.: 12/993,526

(22) PCT Filed: May 20, 2009

(86) PCT No.: PCT/CA2009/000688

§ 371 (c)(1),
(2), (4) Date: Nov. 19, 2010

(87) PCT Pub. No.: WO2009/140760

PCT Pub. Date: Nov. 26, 2009

(65) Prior Publication Data

US 2011/0067333 A1 Mar. 24, 2011

Related U.S. Application Data

(60) Provisional application No. 61/054,983, filed on May 21, 2008.

(51) Int. Cl.
*E04F 13/00* (2006.01)

(52) U.S. Cl.
USPC ..... 52/311.1; 52/314; 404/42

(58) Field of Classification Search ..... 52/311.1, 52/311.2, 314; 404/41, 42; D25/113
See application file for complete search history.

(56) References Cited

U.S. PATENT DOCUMENTS 653,515 A 7/1900 Kennedy
1,474,779 A 11/1923 Kammer
(Continued)

FOREIGN PATENT DOCUMENTS

BE 570711 11/1961
CA 1150553 7/1983
(Continued)

OTHER PUBLICATIONS

Written Opinion dated Feb. 2, 2006 in related Application No. PCT/CA2005/001644.

(Continued)

*Primary Examiner* — Jeanette E Chapman
*Assistant Examiner* — Daniel Kenny
(74) *Attorney, Agent, or Firm* — Kilpatrick Townsend & Stockton & LLP

(57) ABSTRACT

An artificial stone is disclosed for use in creating a covering for a supporting surface. The artificial stone includes a body for placement on the supporting surface, which is shaped for mating engagement with like stones with intermediate perimeter joints to produce a continuous surface covering. The stone has a facing surface on the body, which facing surface has a contour defining a surface area and is subdivided by at least one simulated joint into a major surface portion and at least one minor surface portion. The major surface portion is free of simulated joints and extends over at least about 60% of the total surface of the facing surface. The stone further includes at least one perimeter recess in the body for generating a gap between the stone and another like stone in mating engagement therewith, which gap is wider than adjacent the adjoining perimeter joint. Stones of this construction can easily be arranged in a regular, repeated pattern to generate a continuous covering for the supporting surface with the surface of the resulting covering having an irregular, natural appearance. The irregular top contours of the stones, the uneven division of the facing surface and the perimeter recesses and the resulting gaps between mating stones simulate the appearance of a natural stone surface covering for walkways, roadways, pavements or walls.

24 Claims, 21 Drawing Sheets

U.S. PATENT DOCUMENTS

| | | | |
|---|---|---|---|
| 1,479,647 | A | 1/1924 | Carroll |
| 1,600,787 | A | 9/1926 | Ardit |
| 1,953,657 | A | 4/1934 | Pierce |
| 2,050,299 | A | 8/1936 | Evers |
| 2,606,428 | A | 8/1952 | Oldfather |
| 2,893,098 | A | 7/1959 | Tilley |
| 2,991,213 | A | 7/1961 | Williams |
| D204,803 | S | 5/1966 | Leeth |
| 3,267,823 | A | 8/1966 | MacRae |
| 3,600,773 | A | 8/1971 | Davis et al. |
| D230,478 | S | 2/1974 | Littman et al. |
| D231,926 | S | 6/1974 | Appleton |
| 3,870,423 | A | 3/1975 | Peitz, Jr. |
| 3,947,192 | A | 3/1976 | Rosenberger |
| 4,026,083 | A | 5/1977 | Hoyt et al. |
| 4,078,760 | A | 3/1978 | Mullins |
| 4,105,354 | A | 8/1978 | Bowman |
| 4,125,341 | A | 11/1978 | Reinschutz |
| 4,131,406 | A | 12/1978 | Fresquez |
| 4,135,840 | A | 1/1979 | Puccini et al. |
| 4,217,740 | A | 8/1980 | Assanti |
| 4,231,677 | A | 11/1980 | Roming |
| D257,824 | S | 1/1981 | Puccini et al. |
| D257,825 | S | 1/1981 | Puccini et al. |
| 4,287,141 | A | 9/1981 | Russell |
| 4,313,689 | A | 2/1982 | Reinschutz |
| 4,349,293 | A | 9/1982 | Rosenberger |
| 4,354,773 | A | 10/1982 | Noack |
| 4,407,480 | A | 10/1983 | Trimmer et al. |
| D272,037 | S | 1/1984 | Puccini |
| 4,452,419 | A | 6/1984 | Saleeba |
| 4,510,725 | A | 4/1985 | Wilson |
| 4,544,305 | A | 10/1985 | Hair |
| D281,505 | S | 11/1985 | Larsesn et al. |
| 4,609,303 | A | 9/1986 | Shumaker |
| 4,627,764 | A | 12/1986 | Scheiwiller |
| 4,773,790 | A | 9/1988 | Hagenah |
| 4,776,723 | A | 10/1988 | Brimo |
| 4,792,257 | A | 12/1988 | Rinninger |
| 4,828,426 | A | 5/1989 | Hendricks et al. |
| 4,838,728 | A | 6/1989 | McKeever |
| 4,921,372 | A | 5/1990 | Hybertson |
| D314,240 | S | 1/1991 | Scheiwiller |
| 5,051,023 | A | 9/1991 | Yoshida et al. |
| 5,108,219 | A | 4/1992 | Hair |
| 5,201,843 | A | 4/1993 | Hair |
| 5,211,895 | A | 5/1993 | Jacklich, Sr. |
| 5,230,584 | A | 7/1993 | Grossman |
| 5,244,303 | A | 9/1993 | Hair |
| D342,528 | S | 12/1993 | Hupp |
| 5,267,810 | A | 12/1993 | Johnson |
| D343,237 | S | 1/1994 | Johnson, II |
| 5,277,514 | A | 1/1994 | Glickman |
| 5,281,047 | A | 1/1994 | Skaug |
| 5,286,139 | A | 2/1994 | Hair |
| D349,967 | S | 8/1994 | Krueger et al. |
| 5,342,142 | A | 8/1994 | Barth et al. |
| 5,348,417 | A | 9/1994 | Scheiwiller |
| 5,487,526 | A | 1/1996 | Hupp |
| 5,496,129 | A | 3/1996 | Dube |
| 5,625,990 | A | 5/1997 | Hazlett |
| 5,713,155 | A | 2/1998 | Prestele |
| 5,797,698 | A | 8/1998 | Barth et al. |
| D397,802 | S | 9/1998 | Terry |
| D399,978 | S | 10/1998 | Barth et al. |
| D404,147 | S | 1/1999 | Woolford |
| 5,884,445 | A | 3/1999 | Woolford |
| 5,921,705 | A | 7/1999 | Hodson et al. |
| D424,212 | S | 5/2000 | Abbrancati |
| D429,343 | S | 8/2000 | Milot |
| D429,530 | S | 8/2000 | Fleishman |
| D431,870 | S | 10/2000 | Ziegler, Jr. |
| D431,871 | S | 10/2000 | Abbrancati |
| 6,168,347 | B1 | 1/2001 | Milot et al. |
| D439,677 | S | 3/2001 | Mattox |
| D452,015 | S | 12/2001 | Aurelius |
| D463,866 | S | 10/2002 | Jang |
| D488,566 | S | 4/2004 | Fleishman |
| 6,715,956 | B1 | 4/2004 | Weber et al. |
| D492,796 | S | 7/2004 | Price |
| 6,881,463 | B2 | 4/2005 | Riccobene |
| D505,733 | S | 5/2005 | Castonguay et al. |
| D506,013 | S | 6/2005 | Anderson et al. |
| D522,667 | S | 6/2006 | Castonguay et al. |
| D537,501 | S | 2/2007 | Riccobene |
| D537,959 | S | 3/2007 | Castonguay et al. |
| D540,954 | S | 4/2007 | Bouchard |
| D543,642 | S | 5/2007 | Castonguay et al. |
| D550,375 | S | 9/2007 | Thomassen et al. |
| D553,260 | S | 10/2007 | Castonguay et al. |
| D553,759 | S | 10/2007 | Hamel |
| 7,393,155 | B2 | 7/2008 | Riccobene |
| 7,425,106 | B2 | 9/2008 | Altmann et al. |
| D590,070 | S | 4/2009 | Castonguay et al. |
| D590,071 | S | 4/2009 | Castonguay et al. |
| D590,072 | S | 4/2009 | Castonguay et al. |
| D606,210 | S | 12/2009 | Thomassen |
| 7,637,688 | B2 | 12/2009 | Riccobene |
| D618,364 | S | 6/2010 | Schrom et al. |
| D624,202 | S | 9/2010 | Thomassen et al. |
| D624,203 | S | 9/2010 | Thomassen et al. |
| 7,850,393 | B2 * | 12/2010 | Hamel ..... 404/36 |
| 7,988,382 | B2 | 8/2011 | Castonguay |
| 8,132,981 | B2 | 3/2012 | Castonguay et al. |
| 8,226,323 | B2 | 7/2012 | Bouchard et al. |
| 8,337,116 | B2 | 12/2012 | Castonguay et al. |
| 2003/0007834 | A1 | 1/2003 | Bolduc et al. |
| 2007/0077387 | A1 | 4/2007 | Riccobene |
| 2007/0217865 | A1 | 9/2007 | Castonguay et al. |
| 2008/0209828 | A1 | 9/2008 | Riccobene |
| 2008/0240857 | A1 | 10/2008 | Ciccarello |
| 2010/0236174 | A1 | 9/2010 | Castonguay et al. |
| 2010/0307092 | A1 | 12/2010 | Bouchard et al. |
| 2011/0067333 | A1 | 3/2011 | Lacas et al. |
| 2012/0003040 | A1 | 1/2012 | Castonguay et al. |
| 2012/0189386 | A1 | 7/2012 | Castonguay et al. |
| 2012/0247050 | A1 | 10/2012 | Bouchard et al. |

FOREIGN PATENT DOCUMENTS

| | | |
|---|---|---|
| CA | 2083215 | 5/1994 |
| CA | 2519296 | 10/2004 |
| CA | 2569998 | 5/2006 |
| CA | 2616200 | 4/2008 |
| CH | 562921 | 6/1975 |
| DE | 7122262 | 11/1971 |
| DE | 3533020 | 3/1987 |
| DE | 9211118 | 3/1993 |
| DE | 4232300 | 3/1994 |
| DE | 29922003 | 2/2000 |
| DE | 20101214 | 5/2002 |
| FR | 2354416 | 1/1978 |
| GB | 1047163 | 12/1987 |
| GB | 2208883 | 4/1989 |
| GB | 2214206 | 8/1989 |
| JP | 2002/285504 | 10/2002 |
| JP | 1180760 | 6/2003 |
| JP | 1180761 | 6/2003 |
| JP | 1180860 | 6/2003 |
| JP | 1180861 | 6/2003 |
| JP | 2004-124634 | 4/2004 |
| JP | 3640654 | 1/2005 |
| NL | 7415523 | 6/1976 |
| SE | 44357 | 10/1988 |
| WO | 94/15025 | 7/1994 |
| WO | WO0144578 | 6/2001 |
| WO | WO02059423 | 8/2002 |
| WO | WO02095133 | 11/2002 |
| WO | WO2005084900 | 9/2005 |
| WO | WO2006045192 | 5/2006 |
| WO | WO2009039617 | 4/2009 |
| WO | WO2009140760 | 11/2009 |

OTHER PUBLICATIONS

Written Opinion dated Dec. 15, 2008 in related Application No. PCT/CA2008/001656.

Written Opinion dated Sep. 8, 2009 in related Application No. PCT/CA2009/000688.

"U.S. Appl. No. 11/573,142, Non Final Office Action", mailed Sep. 23, 2009.
"U.S. Appl. No. 12/680,284, Non Final Office Action," mailed Oct. 5, 2011.
"U.S. Appl. No. 12/729,909, Non Final Office Action", mailed Aug. 6, 2010.
"U.S. Appl. No. 12/729,909, Response to Non Final Office Action", filed Feb. 7, 2011.
"U.S. Appl. No. 12/729,909, Notice of Allowance", mailed Mar. 24, 2011.
"U.S. Appl. No. 13/167,053, Notice of Allowance", mailed Nov. 4, 2011.
"U.S. Appl. No. 29/250,971, Non Final Office Action", mailed Dec. 10, 2008.
"U.S. Appl. No. 29/250,971, Response to Restriction Requirement", filed Jan. 12, 2009.
"U.S. Appl. No. 29/250,971, Non Final Office Action", mailed Mar. 5, 2009.
"U.S. Appl. No. 29/250,971, Response to Non Final Office Action", filed Jun. 3, 2009.
"U.S. Appl. No. 29/250,971, Final Office Action", mailed Jul. 21, 2009.
"U.S. Appl. No. 29/250,971, Preliminary Amendment", filed Dec. 18, 2009.
"U.S. Appl. No. 29/250,971, Final Office Action", mailed Mar. 2, 2010.
"U.S. Appl. No. 29/250,971, Response After Final Office Action", filed May 3, 2010.
"U.S. Appl. No. 29/250,971, Notice of Allowance", mailed May 24, 2010.
"U.S. Appl. No. 29/338,035, Non Final Office Action", mailed Feb. 3, 2010.
"U.S. Appl. No. 29/338,035, Response to Office Action", filed May 3, 2010.
"U.S. Appl. No. 29/338,035, Notice of Allowance", mailed May 24, 2010.
Lawrence, Backyard Brickwork, 1989, p. 76, Garden Way Publishing, Pownal, VT, U.S.A.
Fitzgerrell, Basic Masonry Illustrated, a Sunset Book, 1981, pp. 76-77, Lane Publishing Co., Menlo Park, CA, U.S.A.
Bomanite Corp.—Leadership a Reputation for Excellence, Innovation & Experience, 1994, Bomanite International Society, Madera, CA, U.S.A.
Brickform Patterns—1 Sheet, 1994.
Brickform Texture Mats—2 Sheets, 1988.
Brickform Tools-Texture Mats—4 Sheets, Undated—Admitted Prior Art.
Color Tile Advertisement, Royal Rock Ceramic Tile, Jan. 14, 1990, Houston Post, Houston, TX, U.S.A.
Creative Impressions, Ltd., Export Price List and Drawings, Apr. 1990, U.K.
Exhibit G—Photocopy of Front of Color Tile Royal Rock Ceramic Tile, Undated—Admitted Prior Art.
Exhibit H—Photocopy of Rear of Color Tile Royal Rock Ceramic Tile, Undated—Admitted Prior Art.
Decristoforo, Handyman's Guide to Concrete and Masonry, 1978, pp. 183-189, Reston Publishing Co., Inc., Reston, VA, U.S.A.
Decristoforo, Handyman's Guide to Concrete and Masonry Handbook, 1960, p. 70, Arco Publishing Co., Inc., New York City, NY, U.S.A.
Lasting Impressions in Concrete, Inc., Undated, CA, U.S.A. Admitted Prior Art.
Patterned Concrete Industries, Inc., Specifications, Undated, Houston, TX, U.S.A. Admitted Prior Art.
Sweet's Catalog, vol. 2 Bomacron Patterns, 1994.
Sweets General Building and Renovation, 1993 Catalog File, p. 11, Anchor Buyline 6518, 04200/ANC.
Duncan, The Complete Book of Outdoor Masonry, 1977, pp. 342-345, TAB Books, Blue Ridge Summit, PA, U.S.A.
Uni-Group U.S.A.—Manufacture of Uni Paving Stones The Original. The Best., 1992, Palm Beach Gardens, FL, U.S.A.
Extended European Search Report dated Apr. 18, 2011 in related Application No. 05799111.9.
Notice of Allowance in related U.S. Appl. No. 13/367,117, dated Aug. 23, 2012, 11 pages.
Office Action in related U.S. Appl. No. 13/494,922, dated Sep. 18, 2012, 14 pages.
"U.S. Appl. No. 13/367,117, Ex Parte Quayle Action", mailed May 24, 2012.
"U.S. Appl. No. 12/680,284 , Response", mailed Feb. 6, 2012.
"U.S. Appl. No. 12/680,284 , Notice of Allowance", mailed Mar. 12, 2012.
Ex Parte Quayle Action in related U.S. Appl. No. 13/619,606, dated Nov. 8, 2012, 11 pages.
Response to Non Final Office Action in related U.S. Appl. No. 13/494,922, dated Jan. 18, 2013, 20 pages.
Response to Ex Parte Quayle Action in related U.S. Appl. 13/619,606, dated Feb. 8, 2013, 13 pages.

* cited by examiner

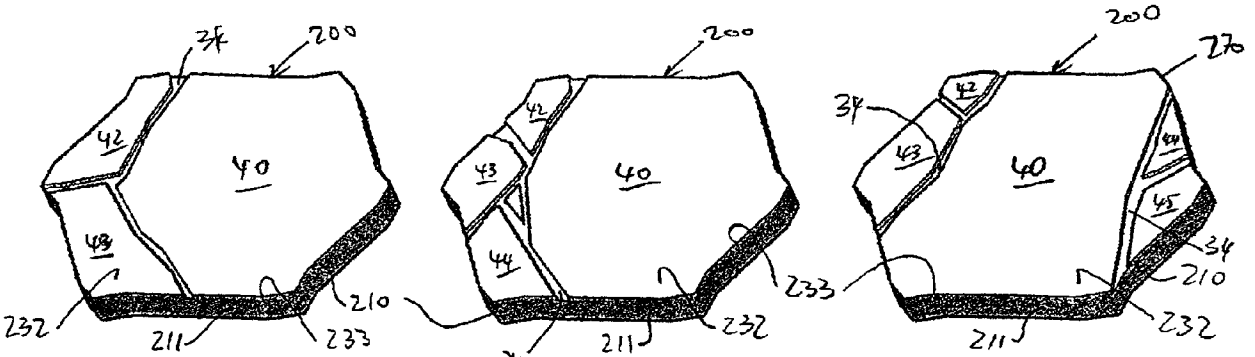
FIG 18a
FIG 18b
FIG 18c
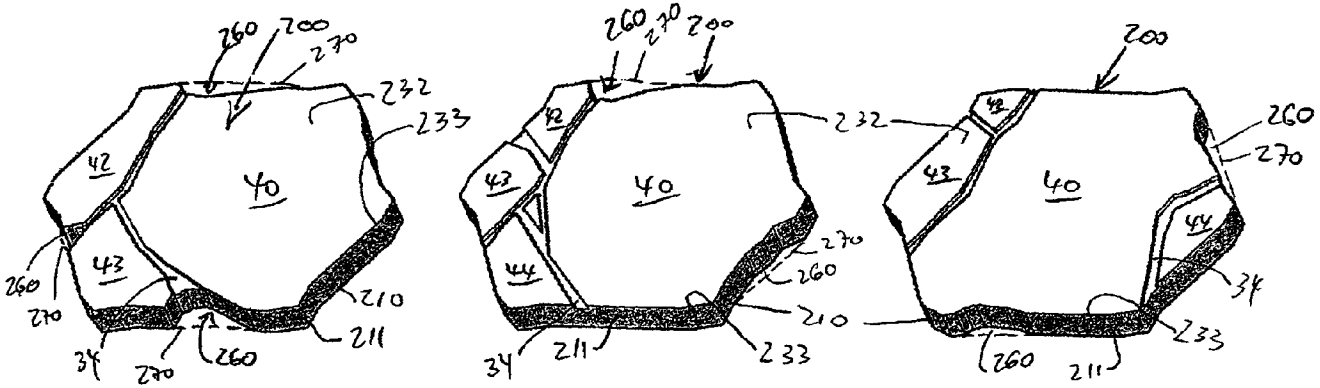
FIG 18d
FIG 18e
FIG 18f

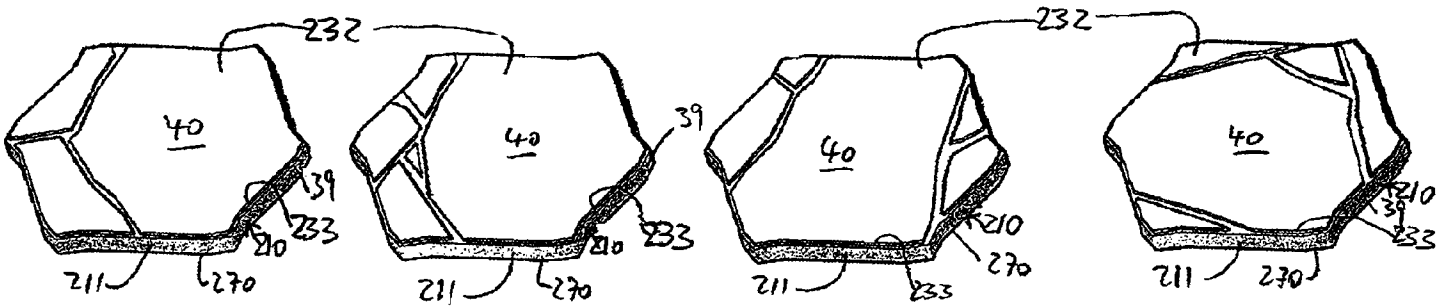
FIG 20a
FIG 20b
FIG 20c
FIG 20d
FIG 20e
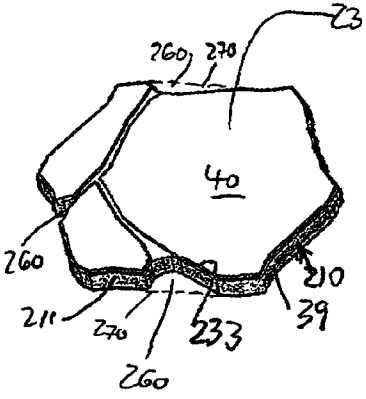
FIG 20f
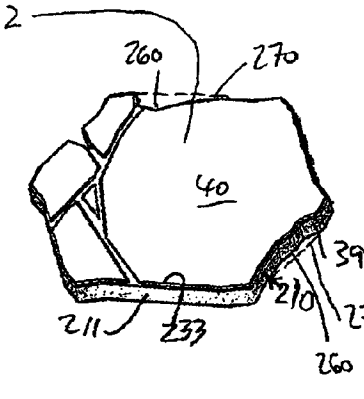
FIG 20g
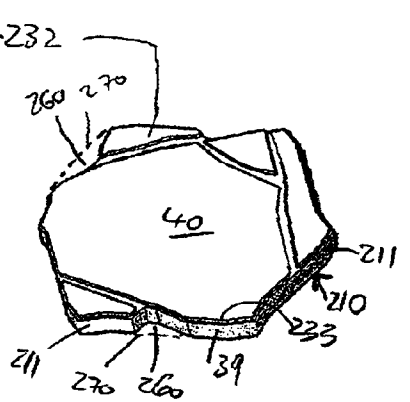
FIG 20h

ARTIFICIAL STONE

CROSS REFERENCE TO RELATED APPLICATIONS

This application is a U.S. national phase patent application under 35 U.S.C. 371 of International Patent Application No. PCT/CA2009/000688 filed May 20, 2009, which claims the benefit of U.S. Provisional Application No. 61/054,983 filed May 21, 2008. The contents of all of which are incorporated herein by this reference.

FIELD OF THE INVENTION

The present invention relates to surface coverings and artificial stones for forming a surface covering. More particularly, the invention relates to stones, flagstones, pavers, bricks, veneer blocks and tiles for forming surface coverings, such as walkways, roadways, pavements or wall coverings.

BACKGROUND OF THE INVENTION

It is well known in the art that surfaces, such as walkways, driveways, patios, floors, work surfaces, walls and other interior or exterior surfaces can be covered for durability and aesthetics with flagstones, stones, bricks, pavers, tiles and other architectural surface covering elements. Natural stone surface coverings are constructed by fitting together irregularly sized and shaped flat stones, such as flagstone, stone and slate. This work requires a skilled stonemason to select, cut and fit the stones. It is labor intensive, and accordingly expensive. To minimize installation time, the stonemason uses a combination of large stones or slabs, for achieving as much surface coverage in as short a time as possible, and a collection of small stones, so called filler stones, for filling in any gaps between the irregularly shaped large stones.

Various efforts have been made to develop artificial building elements, such as bricks, stones, flagstones, pavers, or the like with the appearance of natural stone. Such artificial building elements are usually relatively inexpensively mass produced by molding them from concrete, usually in a dry casting operation. They are typically provided in geometric shapes, such as triangles, squares, rectangles and hexagons, or in irregular shapes, or combinations thereof. The goal is to provide units of preset shape, which can be placed side by side in mating arrangement to produce a continuous surface covering. However, even if irregularly shaped stones are used, the repetitive nature of the installation usually results in a repeating, sometimes even geometric pattern, or at least a 'linear line effect'. This counteracts any 'natural' appearance of the overall surface covering, despite the almost 'natural' appearance of the individual elements. Furthermore, even irregularly shaped stones with randomly placed simulated joints embossed into their facing surface, when laid out in mating arrangement still produce a repeating pattern, since the overall shape of the stones becomes apparent from the pattern of the perimeter joints around the stones, once multiple stones are laid out in a repeating pattern. Thus, these stones still fail to provide an aesthetically pleasing appearance with a degree of natural irregularity close to that of custom installations of natural stone.

Thus, there still exists a need for an artificial stone, flagstone, paving stone or the like which upon installation in a mating array with like artificial stones provides the appearance of a natural stone installation with large slabs and intermediate small filler stones.

SUMMARY OF THE INVENTION

Throughout the description, the expressions 'stone' and 'flagstone' are used interchangeably without distinction and to designate any blocks, stones, flagstones, paving stones, pavers, siding bricks or blocks, veneer bricks, and the like. Therefore, the expressions "artificial stone" and "artificial flagstone" should be given their broadest possible meaning and should be interpreted to encompass any and all artificial stone elements for forming any surface covering.

The term "artificial" is used throughout this specification to designate any non-naturally occurring product.

The term "regular" as used in relation to the geometric shape of various parts of the artificial stone in this specification is used to define a regular geometric shape.

The term "simulated joint" as used in this specification describes all structures which penetrate the facing surface of an artificial stone to divide the facing surface into surface portions. The simulated joints preferably extend only through a portion of the height of the artificial stone, so that when the unit is installed, they provide the appearance of a regular joint between individual stones, giving the visual impression of an arrangement of smaller subunits. The simulated joints preferably are sufficiently deep to retain the joint filler material used for installation of the artificial stones, such as sand or mortar, but do not affect the integrity of the stone during normal handling and installation. The term "perimeter recess" is used throughout this specification to describe a recess, cut-away, or notch along the outer edge of the artificial stone, which extends into the body of the stone from the perimeter and up to the surface of the stone to create the appearance of a cut-away or notch in the body of the stone at the perimeter. The perimeter recess gives the artificial stone the appearance of a natural stone having peripheral shape imperfections and results in a gap between the stone and another like stone placed in engagement therewith. Since the perimeter recess extends into the body from the perimeter, the gap is wider then the adjoining perimeter joint.

The overall appearance of a mating array of artificial flagstones varies depending on the degree of subdivision of the facing surface of the individual stones. However, even when artificial flagstones with mutually different surface subdivisions are used, once they are arranged in a regular array, a discernible repeating pattern appears, irrespective of the surface subdivisions of the individual stones. This is due to the perimeter joints between the stones forming a regular, repeating pattern, since all the stones have the same body shape. It has now been surprisingly discovered that even a repeating pattern of flagstones of substantially identical body shape can be made to have a substantially random or natural appearance. This can be achieved by not only dividing the facing surface of the individual stones by one or more simulated joints to provide the appearance of a large stone or slab and one or more adjacent and smaller filler stone, but by further providing the stones with a perimeter recess. The natural appearance effect becomes especially apparent when the facing surface is designed to include a major area free of any subdividing, simulated joints so that the resulting artificial stone has a facing surface including a major surface area free of any simulated joints and having the appearance of a slab. It has been surprisingly discovered that even when artificial stones in accordance with the invention are installed in a repeating installation pattern with intermediate perimeter joints, a substantially random or natural appearance is generated by the inclusion of the perimeter recess. Including one or more recesses in one or more stones in the repeating pattern, preferably in each stone, results in one or more holes or gaps in the surface covering produced by the mating array, which gaps are then filled with sand, mortar or like filler material after placement of the artificial stones to form the surface covering. These gaps appear identical to gaps found in arrangements of natural stones due the shape mismatch of natural stones. Most importantly, those gaps are provided to interrupt the perimeter joints between adjoining stones and to thereby break up the perimeter joint pattern in an array of like stones arranged in a repeating installation pattern. The resulting overall appearance of the surface covering of artificial stones of the invention is then one of a multitude of larger stones, intermediate smaller stones and joints between the stones, with some joints widening out into the gaps formed by the perimeter recesses. Each gap is preferably larger than the adjoining perimeter joint and at most 5 times as large as the perimeter joint.

In one preferred aspect, the present invention provides an artificial flagstone for covering a supporting surface, which flagstone includes a body with a facing surface and base surface for placement on the supporting surface. The body has a body shape with a polygonal body contour which defines the footprint of the stone. The facing surface has a total surface area defined by a facing contour. The facing surface is subdivided by at least one simulated joint into a major surface portion and at least one minor surface portion. The major surface portion is continuous and free of simulated joints, extends over at least about 60% of the total surface area and has the appearance of a slab, while the minor surface portion has the appearance of a filler stone.

In another preferred aspect of the invention, the major surface portion extends over at least about 65%, preferably at least about 68%, most preferably at least about 70% of the total surface area.

In still another preferred aspect of the invention, the major surface portion extends over at least about 75%, preferably at least about 80% of the total surface area, most preferably at least about 85%.

In a further preferred aspect of the invention, the minor surface portion extends over at most about 30% of the total surface area and is free of simulated joints. In still a further preferred aspect of the invention, the surface area is divided into a major surface portion and a pair of minor surface portions, the combined area of the minor surface portions being at most about 30% of the total surface area. Preferably, the surface area is divided into a major surface portion and a plurality of minor surface portions, the combined area of the minor surface portions being at most about 35%, preferably at most about 30%, most preferably at most about 25% of the total surface area and the simulated joints cover at most about 5% of the total surface area.

In yet a further preferred aspect of the invention, the major surface portion of the facing surface extends over at least 70% of the footprint of the stone, the minor surface portion extends over at least 15% of the footprint, the simulated joints cover at most 5% of the footprint and the perimeter recesses cover at most 10% of the footprint.

Artificial flagstones in accordance with the invention for covering a supporting surface preferably include a polygonal footprint and a body shaped as a right prism for mating engagement of the flagstone with like flagstones in an array or repeating installation pattern for producing a surface covering.

Preferably, the facing surface has a facing contour fitting within the footprint of the body. The facing surface preferably has a surface structure with the appearance of natural stone. The contour of the facing surface is preferably irregular for enhancing the natural appearance of the stone. To further enhance the natural appearance, the facing surface preferably has at least one irregularly shaped protrusion or depression for giving the facing surface the appearance of natural stone. More preferably, the facing surface has at least one irregularly shaped protrusion and at least one irregularly shaped depression.

Most preferably, the perimeter recess extends from the facing surface all the way to the base surface so that a gap or hole is formed between the flagstone and an adjacent, mating flagstone. The gap preferably has a width which is larger then the width of the adjoining perimeter joint. The perimeter recess can be placed anywhere along the perimeter of the artificial stone, but is preferably placed at a corner of the flagstone, or adjacent an end of a simulated joint to further enhance the natural appearance of a surface covering of mating flagstones in accordance with the invention.

Artificial stones in accordance with the invention are preferably made by dry casting and the perimeter recess is preferably made by a division plate used in the dry cast mold. In a variant, the facing surface has at least two areas of different elevation, which areas are preferably irregularly shaped areas.

In another aspect of the invention, the artificial stone is breakable along at least one of the simulated joints. This allows breaking off one or more of the minor surface portions, while still rendering possible a mating engagement of the broken artificial stone with other like units, either complete or broken off, and provides greater flexibility for size adjustment during installation. The simulated joints may in some locations extend all the way to the base surface of the artificial stone to facilitate breaking off of the minor surface portion, as long as this does not affect the integrity of the stone during normal handling and installation.

In a further preferred aspect of the invention, the artificial stone is shaped and constructed as a paving stone. The artificial stone of the invention is preferably made by dry casting and is most preferably is a dry cast paving stone.

In still another preferred aspect, the invention provides a set of artificial stones for producing a surface covering in a regular, repeated pattern, but with an irregular surface appearance, simulating the appearance of natural stone. The set includes at least two flagstones with a body of polygonal cross-section and shaped as a right prism to fit together in a mating arrangement, and an irregularly shaped facing surface. The facing surface of one flagstone in the set is different in appearance from the facing surface of every other flagstone in the set and especially differs in the placement and/or number of the simulated joints and the placement and/or number of the perimeter recess regions. Preferably, the set of flagstones includes all the stones made within a multi-cavity dry casting frame, whereby each cavity produces a stone with a different facing surface.

BRIEF DESCRIPTION OF THE DRAWINGS

Other objects and advantages of the invention will become apparent upon reading the detailed description and upon referring to the drawings in which:

FIGS. 18*a* to 18*c* show schematic isometric views of artificial stones with a generally hexagonal footprint and a facing surface divided into a major surface portion covering at least 70% of the facing surface and one or more minor surface portions and FIGS. 18*d* to 18*f* show the same stones, but having at least one perimeter recess;

FIGS. 20*a* to 20*d* are schematic isometric views of artificial stones with a right rectangular base portion and a top portion with a facing surface of an irregular outline fitting within the rectangular footprint of the base portion and FIGS. 20*e* to 20*h* show the same stones, but having at least one perimeter recess;

DETAILED DESCRIPTION OF PREFERRED EMBODIMENTS

Before explaining the present invention in detail, it is to be understood that the invention is not limited to the preferred embodiments contained therein. The invention is capable of other embodiments and of being practiced or carried out in a variety of ways. It is to be understood that the phraseology and terminology employed herein are for the purpose of description and not of limitation.

The present invention provides artificial stones, flagstones, bricks, pavers, tiles and the like for forming surface coverings, such as pavements, walkways or wall coverings, having the appearance of a natural stone covering.

Figure 2:
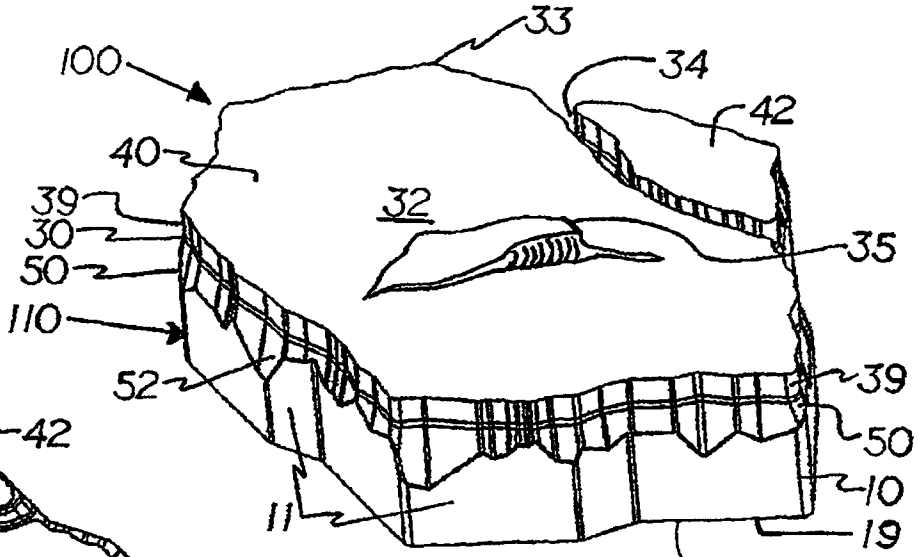
FIG. 2 is a schematic view of the stone shown in FIG. 1.
Figure 1:
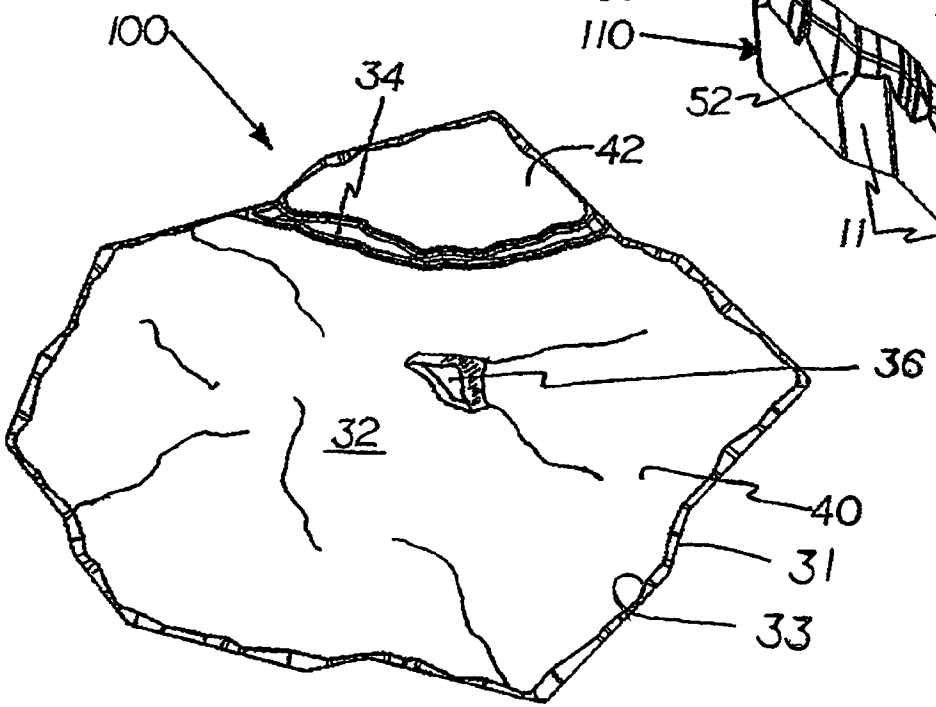
FIG. 1 is a top plan view of an artificial stone in accordance with the invention.
Figure 4:
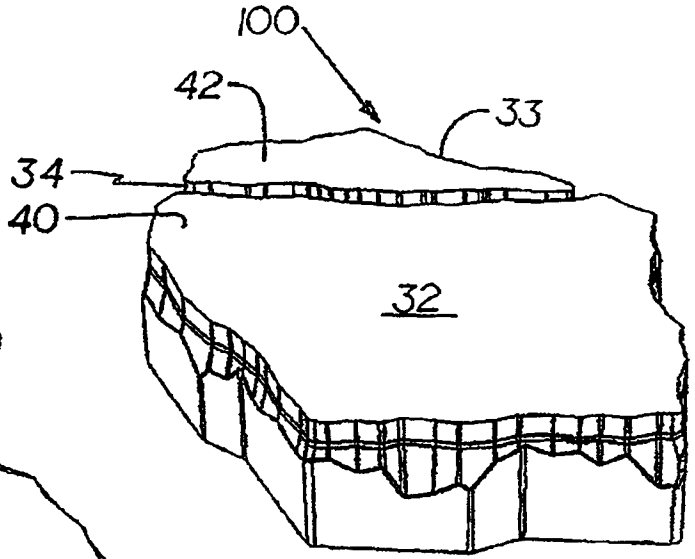
FIG. 4 is a schematic view of the stone shown in FIG. 3.
Figure 3:
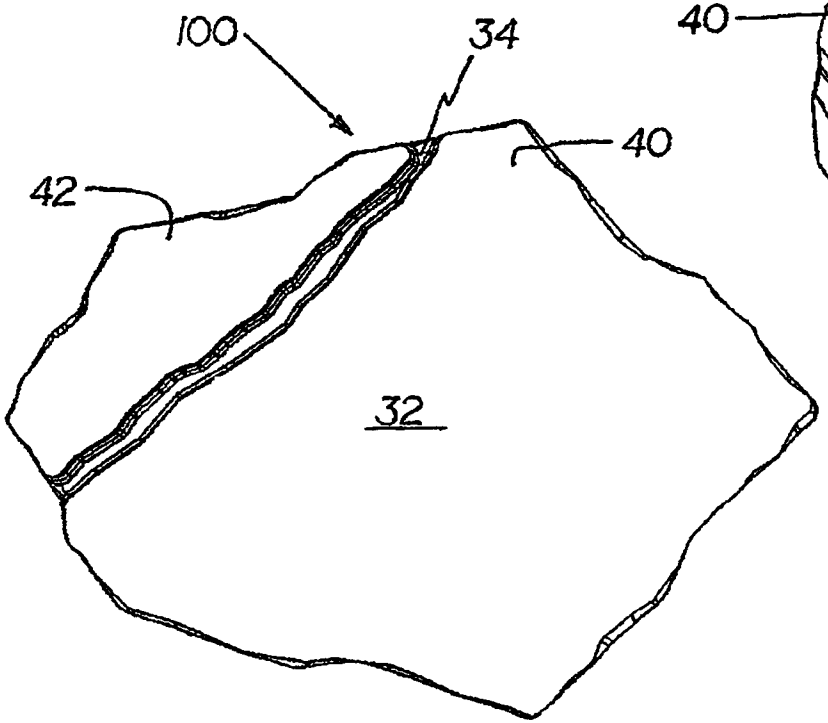
FIG. 3 is a top plan view of another artificial stone in accordance with the invention.
Figure 6:
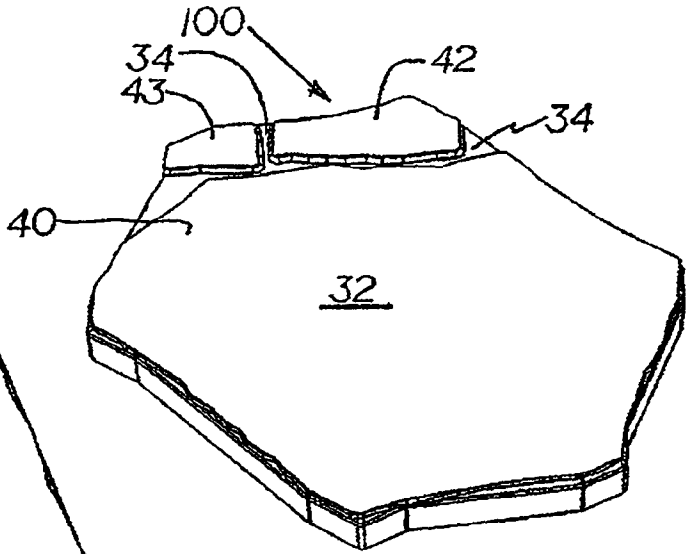
FIG. 6 is a schematic view of the stone shown in FIG. 5.
Figure 5:
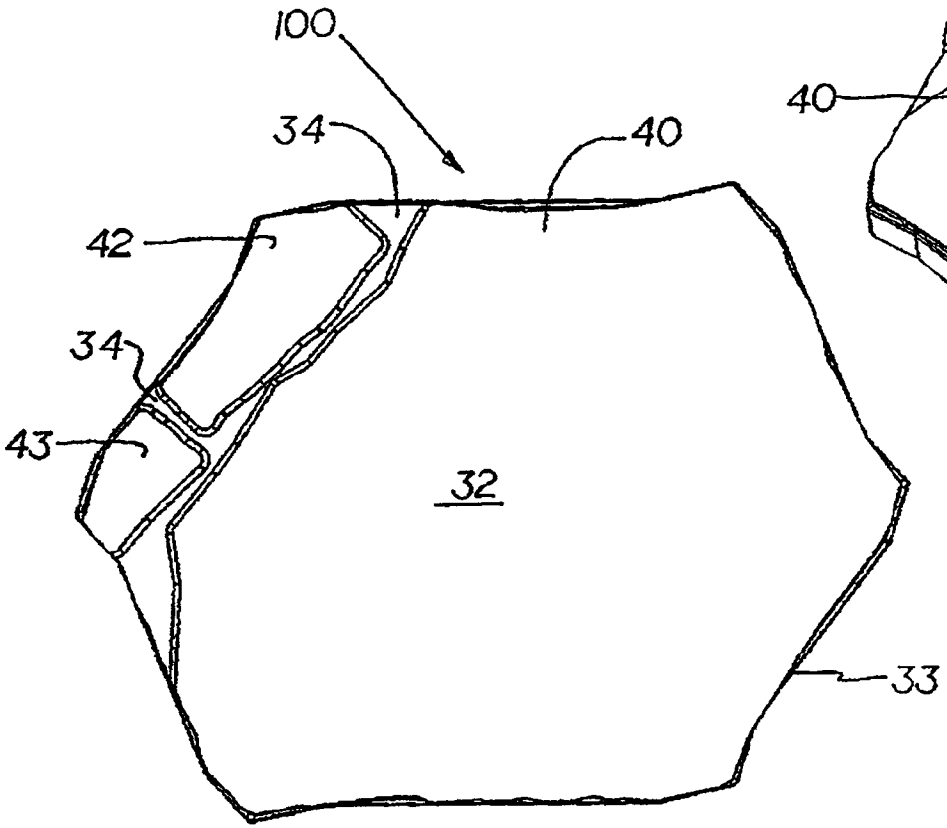
FIG. 5 is a top plan view of a further artificial stone in accordance with the invention.

A preferred artificial stone 100 in accordance with the invention as shown in FIGS. 1 and 2, includes a body 110 having a facing surface 32 on the body and a base surface 19 for placement on a supporting surface (not shown). The body 110 has a body shape with a body contour 31 defining a footprint of the body 110 and, thus, the stone 100. The facing surface 32 has a facing facing contour 33 and a total surface area defined by the facing facing contour 33, which area is divided by at least one simulated joint 34 into a major surface portion 40 and one or more minor surface portions 42, 43, 44, 45. The minor surface portions are preferably located at the facing contour 33. The simulated joints 34 are preferably irregular in appearance and width and have irregular edges. The major surface portion 40 is free of any simulated joints 34 and extends over at least about 60% of the facing surface and has the appearance of a continuous slab, and the minor surface portion has the appearance of a filler stone. As is apparent from FIG. 1, the facing facing contour 33 fits into the body contour 31 or footprint of the body 110.

The major surface portion preferably extends over about 65% of the total surface area, more preferably at least 70%, even more preferably at least 75%, most preferably about 80%.

Figure 8:
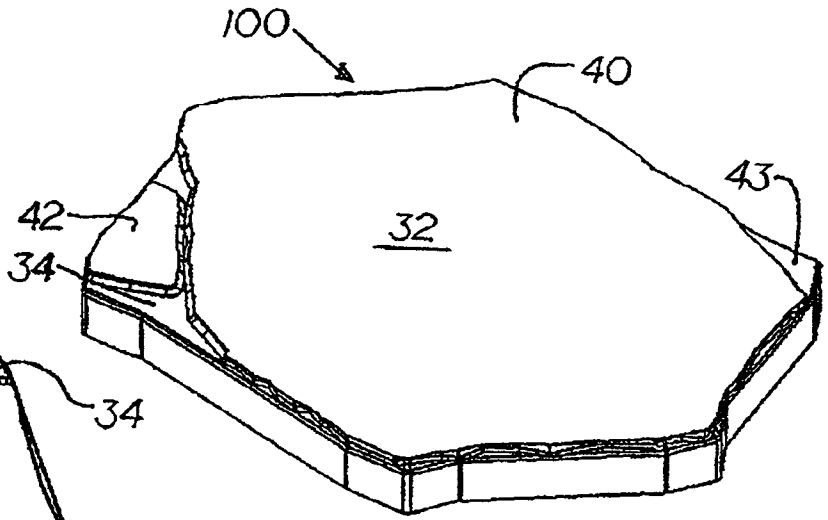
FIG. 8 is a schematic view of the stone shown in FIG. 7.
Figure 7:
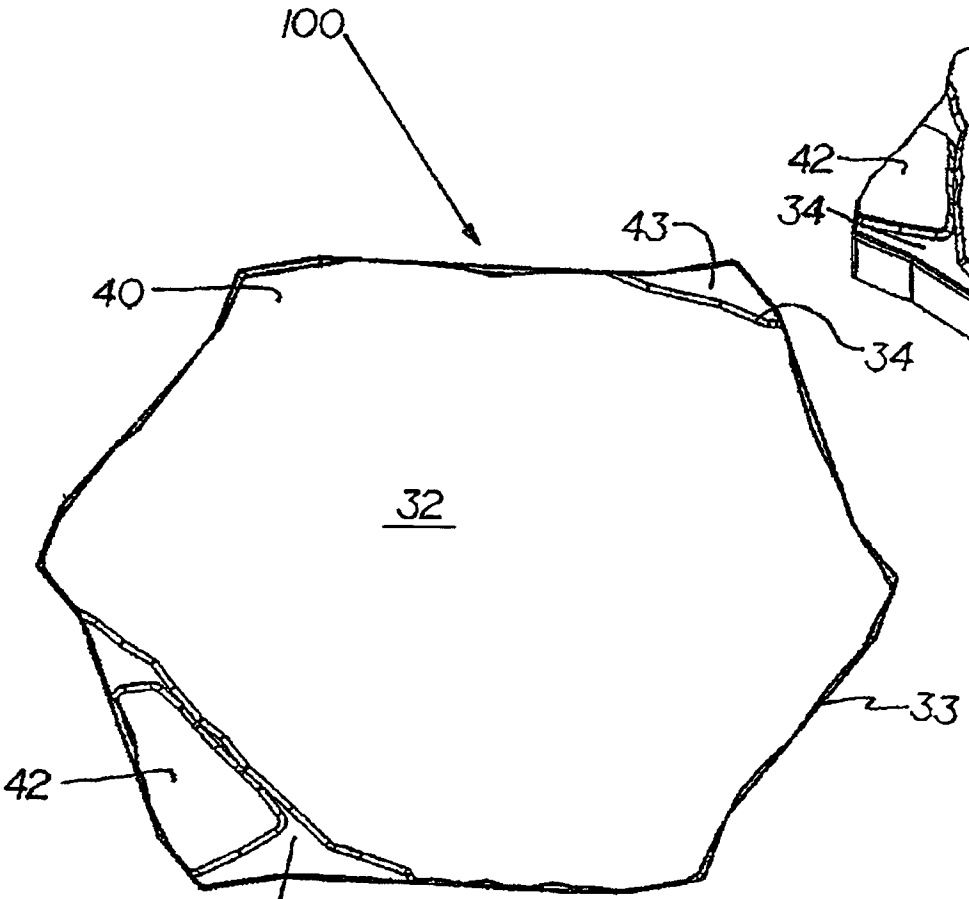
FIG. 7 is a top plan view of still another artificial stone in accordance with the invention.

The facing surface 32 preferably has a polygonal facing contour 33. The simulated joints 34 are preferably positioned to divide off one or more points of the polygonal facing surface 32 (FIGS. 1-4). When more than one simulated joint 34 is provided, (FIGS. 5-8), each joint can be positioned to divide off a separate minor portion 42, 43, respectively located at different corners or points of the facing surface (FIGS. 7 and 8). Alternatively, one simulated joint 34 can be used to divide off a minor portion 42 at one corner or point of the facing surface 32 and one or more additional simulated joints 34 can be used to subdivide this minor portion 42 into multiple minor portions 43, 44.

The simulated joints 34 preferably extend through a portion of the height of the stone 100, so that when the stone is laid out, it gives the visual impression of an arrangement of smaller units, while still retaining the advantages of handling only a larger block. In another aspect of this embodiment, the joints 34 can be sufficiently deep so that the artificial stone 100 may be breakable along the joints 34. This allows breaking off a section of the stone, while still rendering possible a mating engagement of the broken stone with other ones. The simulated joints 34 may in some locations extend all the way to a base surface 19 of the artificial stone to facilitate the breaking off, as long as this does not affect the integrity of the stone during normal handling and installation.

A preferred artificial stone 100 in accordance with the invention as illustrated in FIG. 2 includes a base portion 10 with a base surface 19 for placement on a supporting surface (not shown), for example a wall or a walkway. The base portion 10 is shaped for mating engagement of the stone with like stones in a repeated, mating arrangement to produce a surface covering of stones with intermediate perimeter points (see FIG. 10). In the illustrated embodiment, the base portion 10 of the stone 100 has a polygonal footprint similar to a hexagon. It is readily understood that footprints of other geometric shape, such as triangular, square, rectangular, octagonal, or the like can be used as long as they allow the stone 100 to engage like stones in a mating arrangement or repeating installation pattern. The stone 100 further includes a top portion 30 with a facing surface 32 having a natural appearance and a facing contour 33 with a depending rim 39. An intermediate portion 50 connects the rim 39 with the base portion 10.

The intermediate portion 50 preferably has at least one circumferential portion which it is outwardly tapered. The intermediate portion 50 preferably has at least one sidewall 52 extending between the rim 39 and a sidewall 11 of the base portion 10 and joining the base portion sidewall 11 and the rim 39 at an acute angle of 0 to 25°. This construction greatly facilitates the dry casting operation by ensuring an even distribution of the concrete mix and, thus, an even fill of the mold. Damage to the freshly molded stone during stripping and disengagement from the mold due to sharp corners in the mold and adhesion to mold surfaces is also minimized with this construction.

In the embodiments shown in FIGS. 1 to 8, 11, 13, 15, 17, 18*a*-18*f*, 19, 20*a*-*h* and 21 the base portion 10 has the basic shape of a right prism. This basic structure allows the manufacture of a large number of stones with base portions 10, which easily fit together in a mating arrangement, but have significantly differing top portions 30 and facing surfaces 32. It not only allows for the formation of a reliable and durable surface covering by arranging the stones in a regular pattern, but at the same time provides for great variability in appearance of the top surface 32, resulting in an irregular and natural appearance of the covering due to the differently shaped top portions 30, as will be apparent from the covering arrangements shown in FIGS. 10, 13, 15, 17, 19, 21 and 22. It will be readily apparent that the base portion 10 can have any other shape which allows the stone to be fitted with other stones in accordance with the invention into a mating arrangement forming a surface covering. For example, the base portion 10 may have a square, rectangular, pentagonal, hexagonal, triangular, or irregular polygonal outline or footprint and may be in the shape of a right prism. The base portion 10 may also include spaces (not shown) along the perimeter or body contour 32 of the stone in order to widen the perimeter joints and provide improved drainage between the stones.

The artificial stone 100 is preferably manufactured by dry casting. The facing contour 33 of the facing surface 32 preferably fits into and is located above the footprint of the base portion 10 (see FIGS. 1, 14-17, 20, 21) to enable stripping of the stone 100 from the mold in a dry casting operation. Furthermore, the depending rim 39 is preferably oriented perpendicular to a base surface 19 of the body 110 and the base portion 10. This facilitates dry casting of differing artificial flagstones, since facing surfaces 32 of different appearance and facing contour 33 can be produced with the same mold frame by simply changing the compression shoe of the dry casting mold. The depending rim 39 ensures proper alignment and fit of the shoe and avoids damage to the molded stone during stripping from the mold.

The outline or facing facing contour 33 of the facing surface 32 is preferably irregular for achieving a natural appearance. To further enhance the natural appearance of the top portion 30, the facing surface 32 preferably has at least one irregularly shaped protrusion 35 or depression 36 (see FIGS. 1 and 2) for giving the top portion 30 the appearance of natural stone. More preferably, the facing surface 32 has at least one irregularly shaped protrusion 35 and at least one irregularly shaped depression 36. In a variant, the facing surface has at least two areas of different elevation 37, 38, which areas are preferably irregularly shaped areas.

To avoid the generation of the "linear line effect" often observed with regularly shaped artificial stones in the art, especially those with a polygonal facing surface, the stone 100 of the present invention is preferably provided with a facing surface 32 which is unevenly divided by one or more simulated joints to provide the appearance of a large stone and a small stone.

The exemplary artificial flagstones shown in FIGS. 1-22 are shaped and constructed as paving stones, preferably produced in a dry casting mold. However, it is readily apparent that the artificial stones of the invention can be used as other floor or wall coverings. FIGS. 9*a* to 9*f* show a set of artificial stones 100 in accordance with the invention. Each illustrated artificial stone 100 in accordance with the invention includes a body 110 and a facing surface 32 on the body. The facing surface 32 has a facing facing contour 33, which defined a total surface area of the facing surface. The facing surface is divided by at least one simulated joint 34 into a major surface portion 40 and one or more minor surface portions 42, 43, 44, 45 located at the facing contour 33. The major surface portion 40 is continuous and free of simulated joints 34 and extends over at least about 60% of the facing surface to give it the appearance of a slab. The minor surface portion has the appearance of a filler stone, or multiple filler stones, giving the artificial stone the overall appearance of a large slab stone combined with one or more filler stones.

Figure 9A:
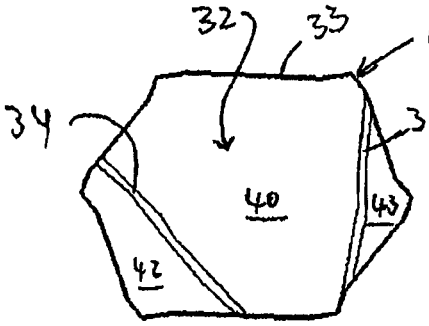
FIGS. 9*a* to 9*g* are schematic views of different artificial stones, each having a major surface portion covering 70% or more of the facing surface.
Figure 9B:
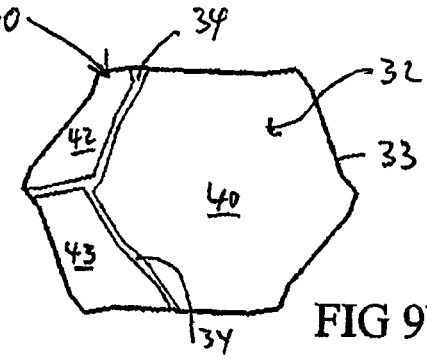
Figure 9C:
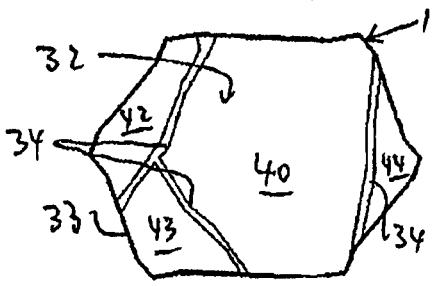
Figure 9D:
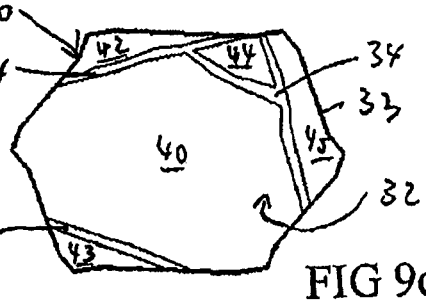
Figure 9E:
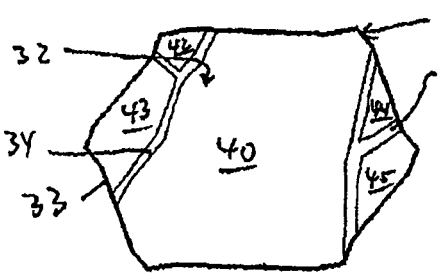
Figure 9G:
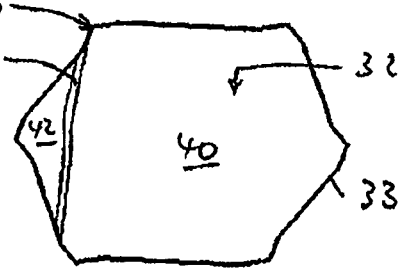
Figure 9F:
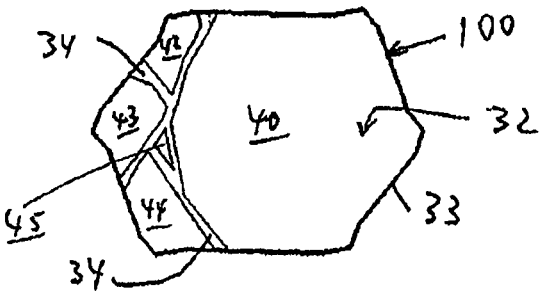

The facing surface 32 preferably has a polygonal facing facing contour 33. The simulated joints 34 are preferably positioned to divide off one or more points or corners of the polygonal facing surface 32. When more than one simulated joint 34 is provided, (FIGS. 9*a*-9*e*, 9*f*), each joint can be positioned to divide off a separate minor portion 42, 43, respectively located at different corners or points of the facing surface (FIGS. 9*a*-9*e*, 9*f*). Alternatively, one simulated joint 34 can be used to divide off a minor portion 42 at one corner or point of the facing surface 32 and one or more additional simulated joints 34 can be used to subdivide this minor portion 42 into multiple minor portions 43, 44, 45 (FIGS. 9*d*, 9*e*, 9*f*). It is also within the confines of the invention to subdivide the minor portion 42 into multiple sub-portions (43, 44, 45) by a plurality of simulated joints 34, whereby one or more of the sub-portions are no longer located at the facing contour 33 (see portion 45 in FIG. 9*f*).

Figure 10:
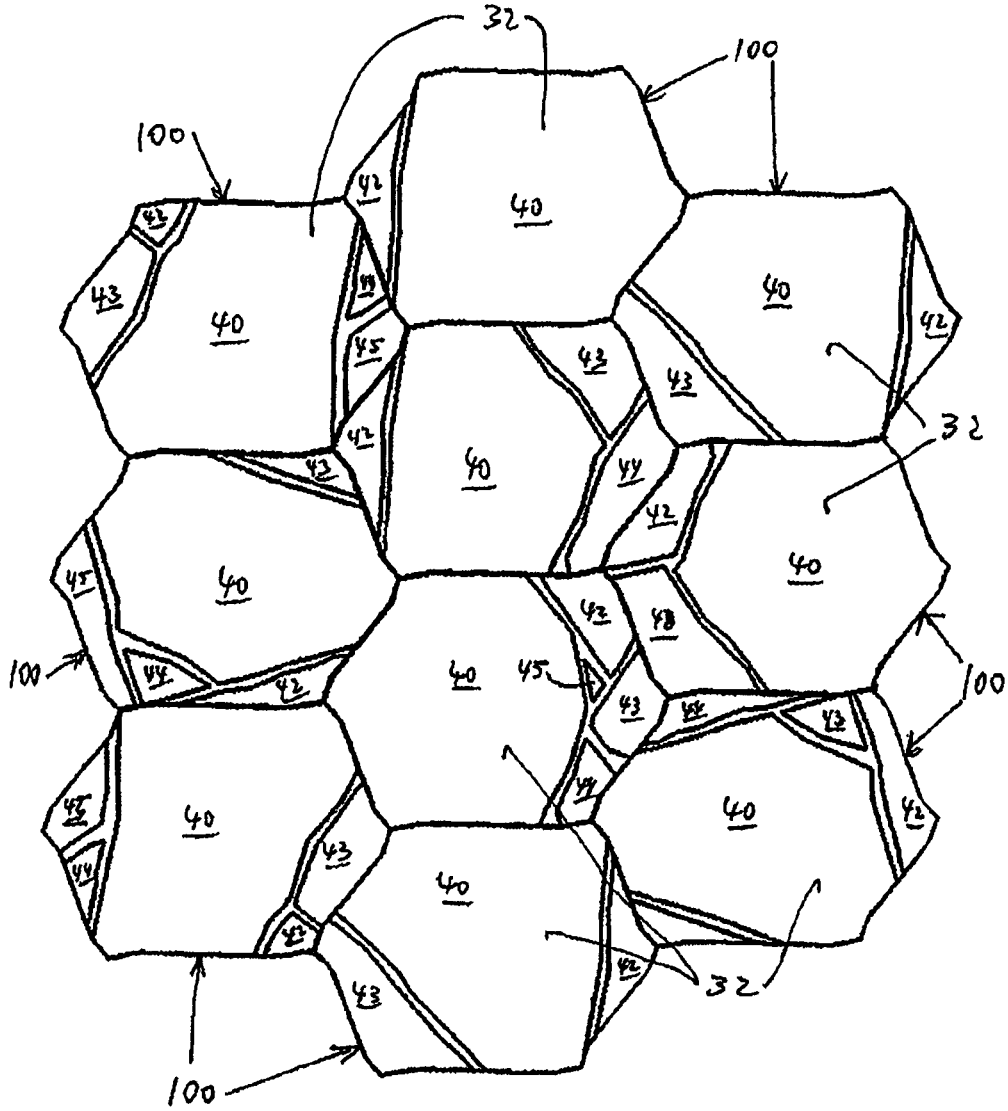
FIG. 10 is a simulated top plan view of a surface covering arrangement using artificial stones as shown in FIGS. 9*a* to 9*g;*
Figure 11:
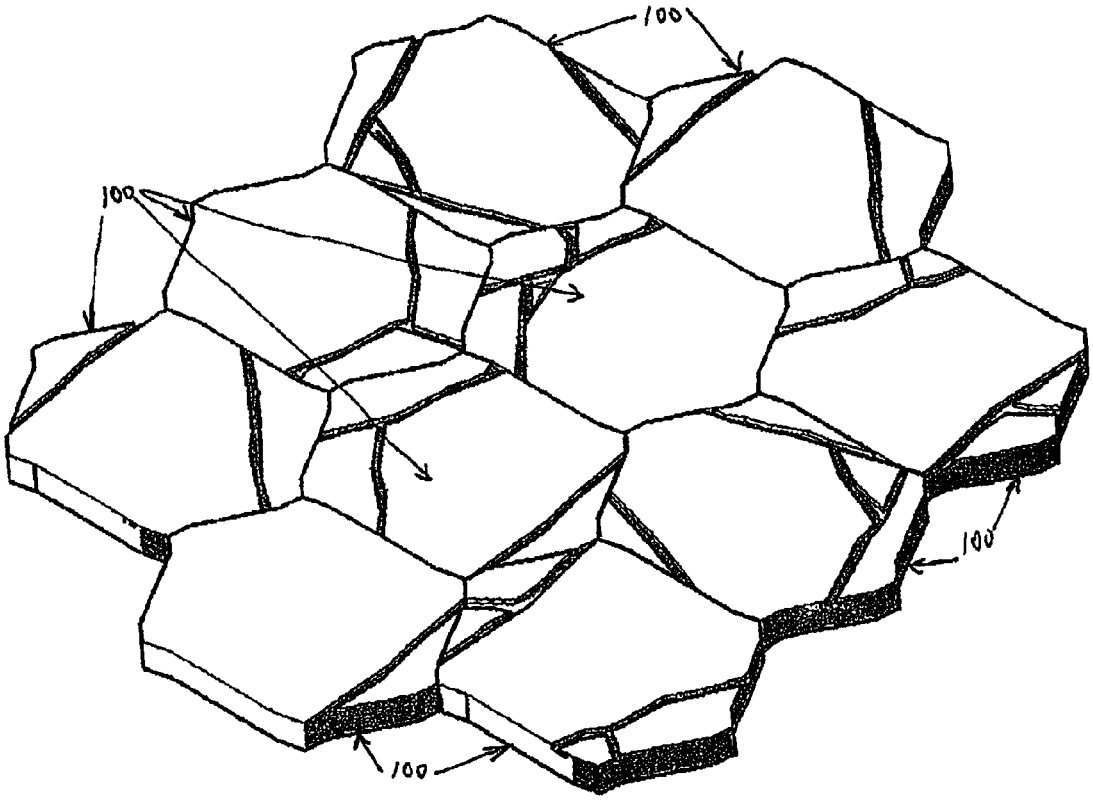
FIG. 11 is a simulated perspective view of a surface covering arrangement using artificial stones as shown in FIGS. 9*a* to 9*g;*
Figure 12A:
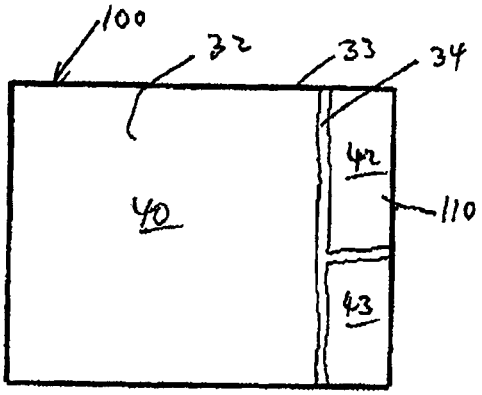
FIGS. 12*a* to 12*d* are schematic views of different artificial stones with rectangular base, each having a major surface portion covering 70% or more of the facing surface.
Figure 12B:
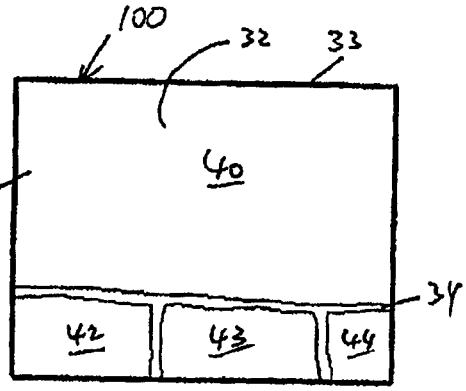
Figure 12C:
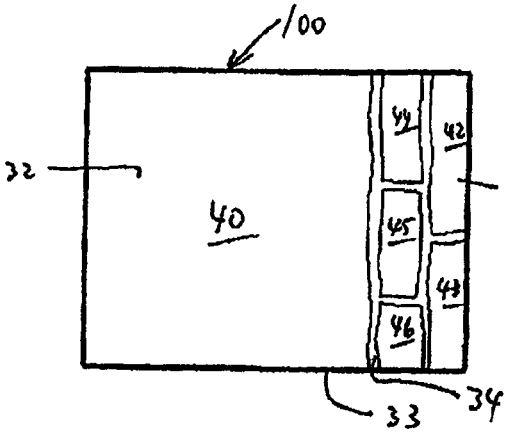
Figure 12D:
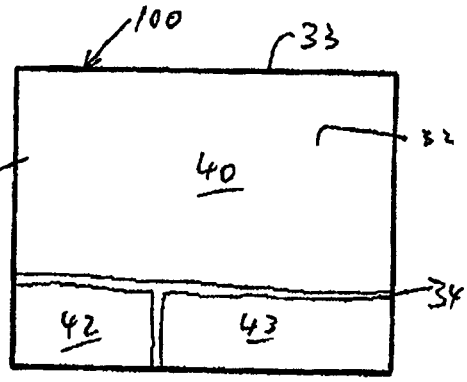

FIGS. 10 and 11 show an arrangement of artificial stones 100 in accordance with the invention resulting in a surface covering with an irregular surface, simulating the appearance of natural stone. Thanks to its particular configuration, when an artificial stone 100 according to the invention is used in combination with other like ones, for defining a surface covering, each stone 100 is matingly engageable with neighboring stones 100. The set shown in FIGS. 10 and 11 includes multiple stones 100 with base portions shaped to fit together in a mating arrangement, producing a continuous surface covering. In the illustrated arrangement of FIGS. 10 and 11, each stone 100 is advantageously provided with a top surface 32 having a texture that imitates a natural artificial stone, such as a natural flagstone. Due to the differing surface structures of the stones 100 and especially the combination on the surface of each stone of a major, slab like surface portion with one or more minor, filler stone like surface portions, the overall surface of the surface covering has an irregular, natural appearance.

FIGS. 12*a* to 12*d* show a set of artificial stones 100 in accordance with the invention. Each illustrated artificial stone 100 in accordance with the invention includes a body 110 in the shape of a right rectangular prism and a facing surface 32 on the body. The facing surface 32 has a facing contour 33 and a surface area and is divided by at least one simulated joint 34 into a major surface portion 40 and one or more minor surface portions 42, 43, 44, 45,46 located at the facing contour 33. The major surface portion 40 is free of simulated joints 34 and extends over at least about 60% of the total surface area of the facing surface and has the appearance of a slab. The minor surface portion has the appearance of a filler stone, or multiple filler stones, giving the artificial stone the overall appearance of a large slab stone combined with one or more filler stones.

In this embodiment, the facing surface 32 has a substantially rectangular facing contour 33. The simulated joints 34 are positioned to divide off one side of the rectangular facing surface 32. When more than one simulated joint 34 is provided, (FIGS. 12*a*-12*d*), the simulated joints can be positioned to sub-divide the cut-off minor portion 42 along the side of the facing contour 33. Two or more simulated joints 34 can be used to divide off the minor portion 42 and to subdivide it into multiple minor portions 43, 44, 45, 46 (FIGS. 12*a*-12*d*). It is also within the confines of the invention to subdivide the minor portion 42 into multiple sub-portions (43, 44, 45, 46) by a plurality of simulated joints 34, whereby one or more of the sub-portions are no longer located at the facing contour 33 (see portion 45 in FIG. 12*c*).

Figure 13:
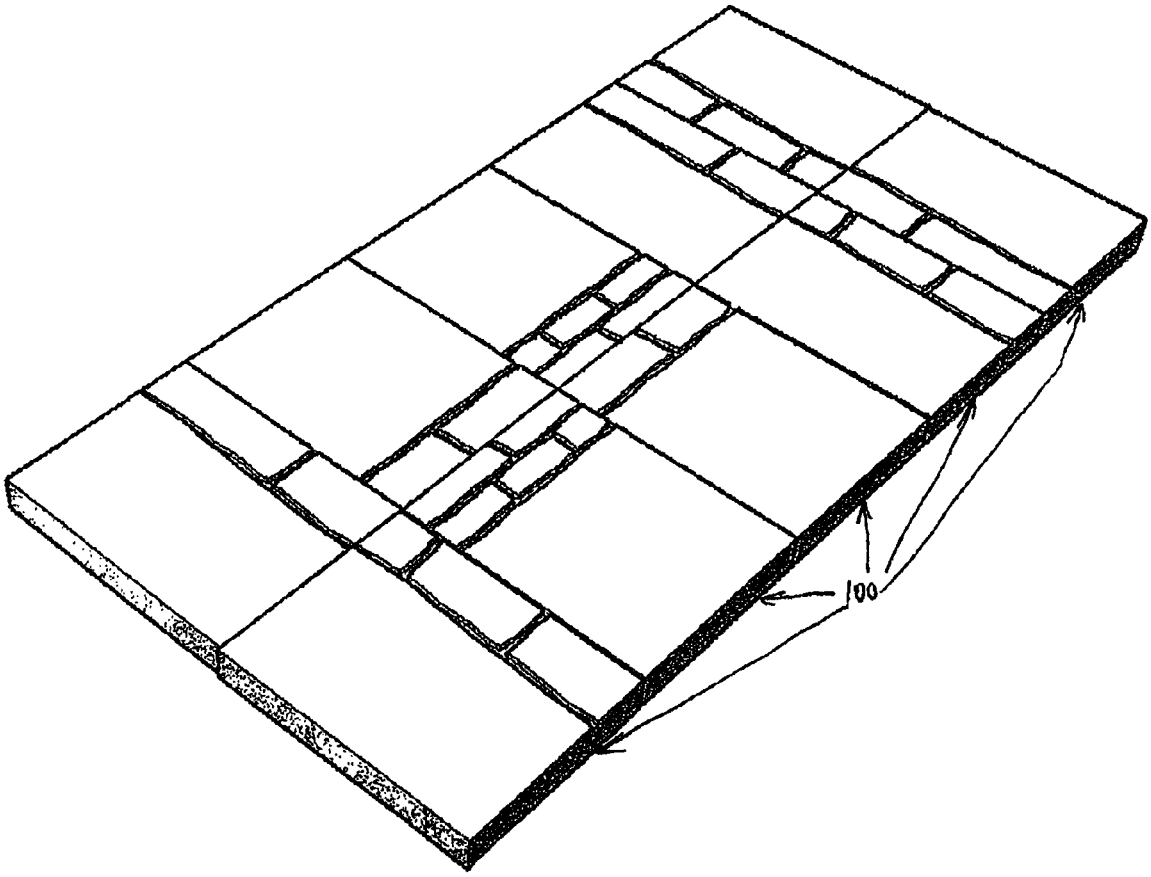
FIG. 13 is a simulated perspective view of a surface covering arrangement using artificial stones as shown in FIGS. 12*a* to 12*d;*

FIG. 13 shows an arrangement of artificial stones 100 of substantially rectangular contour in accordance with the invention resulting in a surface covering with an irregular surface, simulating the appearance of natural stone. Thanks to its particular configuration, when an artificial stone 100 according to the invention is used in combination with other like ones, for defining a surface covering, each stone 100 is matingly engageable with neighboring stones 100. The set shown in FIG. 13 includes multiple stones 100 with base portions shaped to fit together in a mating arrangement, producing a continuous surface covering. Each stone 100 has a top surface texture that imitates a natural artificial stone, such as a natural flagstone. Due to the differing surface structures of the stones 100 and especially the combination on the surface of each stone of a major, slab like surface portion (40) with two or more minor, filler stone like surface portions (42, 43, 44, 45, 46), the overall surface of the surface covering has an irregular, natural appearance.

FIGS. 14*a* to 14*i* show a set of artificial stones 100 in accordance with the invention and similar to those shown in FIGS. 9*a* to 9*f*. However, each artificial stone 100 illustrated in FIGS. 14*a* to 14*i* includes a body 110 with a polygonal body contour 31 defining a footprint of the stone and a facing surface 32 of a polygonal contour different from the one of the body, but fitting within the footprint of the body. This principle relationship between the shape of the facing surface 32 and the body was previously discussed in relation to FIGS. 1 to 8. As with the artificial stones shown in FIGS. 9*a* to 9*f*, the facing surface 32 has a facing contour 33 and a surface area and is divided by at least one simulated joint 34 into a major surface portion 40 and one or more minor surface portions 42, 43, 44, 45, 46, 47 located at the facing contour 33. The major surface portion 40 is free of simulated joints 34 and extends over at least about 60% of the facing surface and has the appearance of a slab. The minor surface portion has the appearance of a filler stone, or multiple filler stones, giving the artificial stone the overall appearance of a large slab stone combined with one or more filler stones.

Figure 14A:
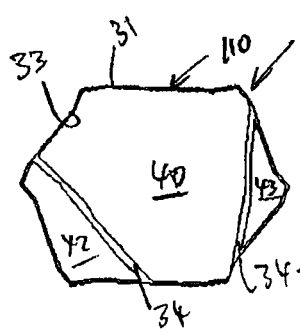
FIGS. 14*a* to 14*i* are schematic views of different artificial stones of a shape similar to those shown in FIGS. 9*a* to 9*g*, each stone having a polygonal base portion and facing surface of irregular, polygonal outline fitting within the polygonal outline of the base portion.
Figure 14B:
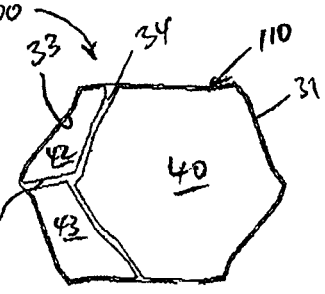
Figure 14C:
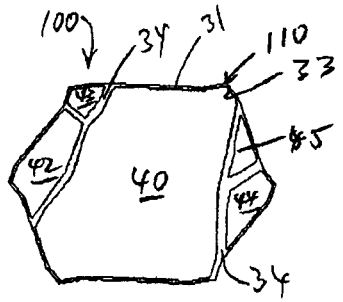
Figure 14D:
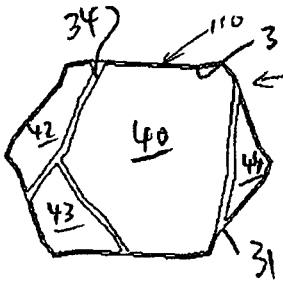
Figure 14E:
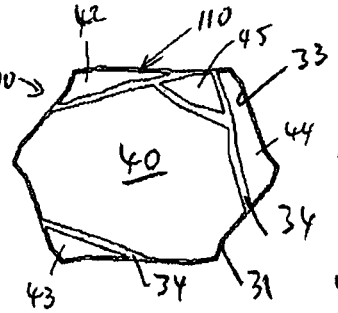
Figure 14F:
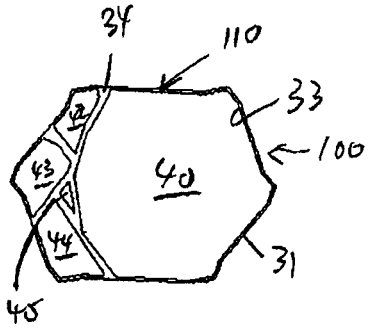
Figure 14G:
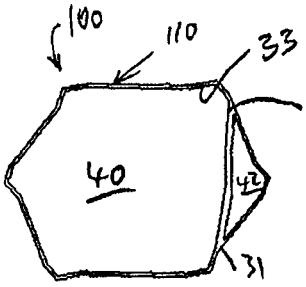
Figure 14H:
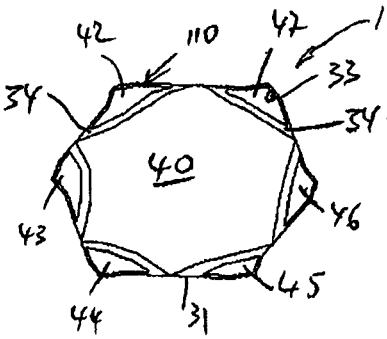
Figure 14I:
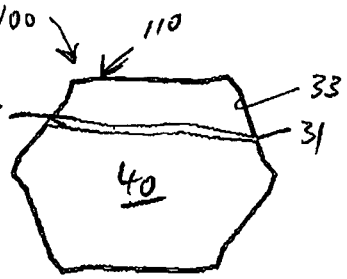

The facing surface 32 preferably has a polygonal facing facing contour 33. The simulated joints 34 are preferably positioned to divide off one or more points or corners of the polygonal facing surface 32. When more than one simulated joint 34 is provided, (FIGS. 14*a*-*f* and 14*h*), each joint can be positioned to divide off a separate minor portion 42, 43, respectively located at different corners or points of the facing surface. Alternatively, one simulated joint 34 can be used to divide off a minor portion 42 at one corner or point of the facing surface 32 and one or more additional simulated joints 34 can be used to subdivide this minor portion 42 into multiple minor portions 43, 44, 45 (FIGS. 14*c* and 14*f*). It is also within the confines of the invention to subdivide the minor portion 42 into multiple sub-portions (43, 44, 45) by a plurality of simulated joints 34, whereby one or more of the sub-portions are no longer located at the facing facing contour 33 (see portion 45 in FIG. 14*f*).

Figure 15:
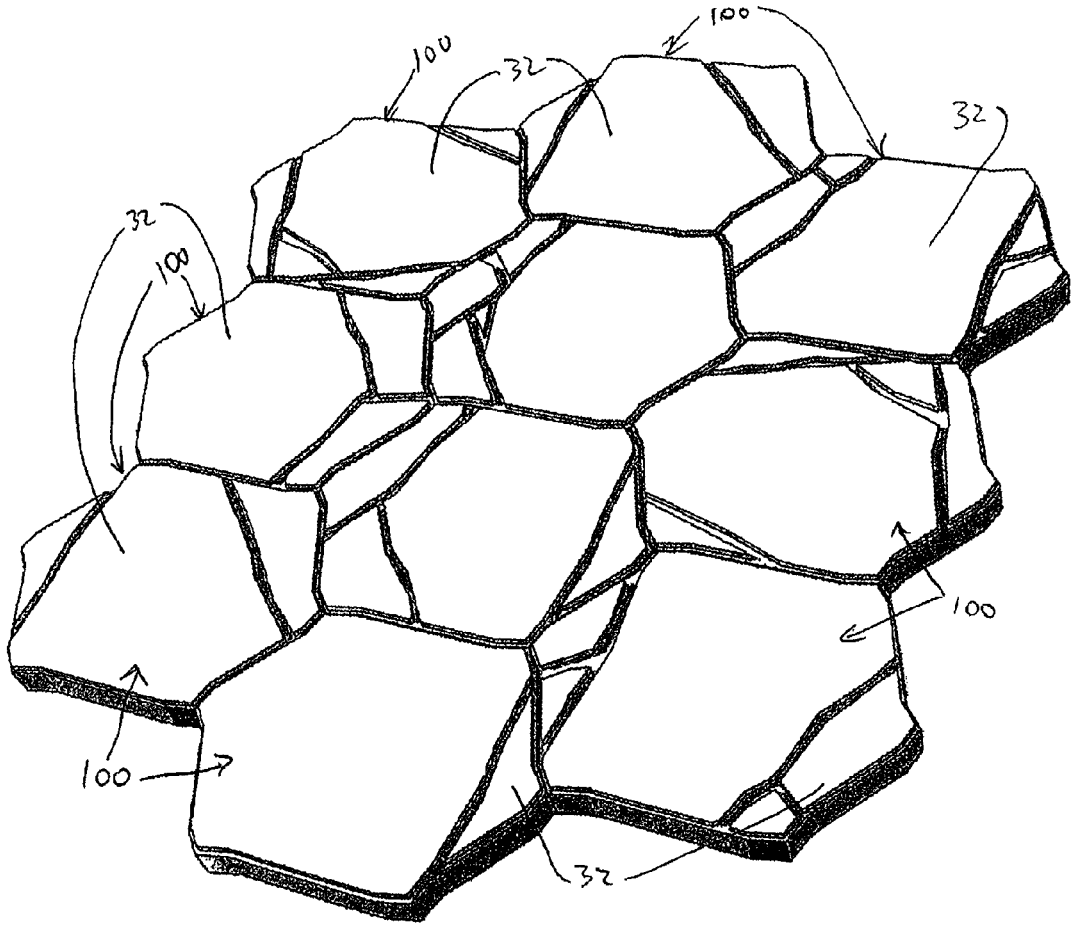
FIG. 15 is a simulated perspective view of a surface covering arrangement using artificial stones as shown in FIGS. 14*a* to 14*g;*
Figure 16A:
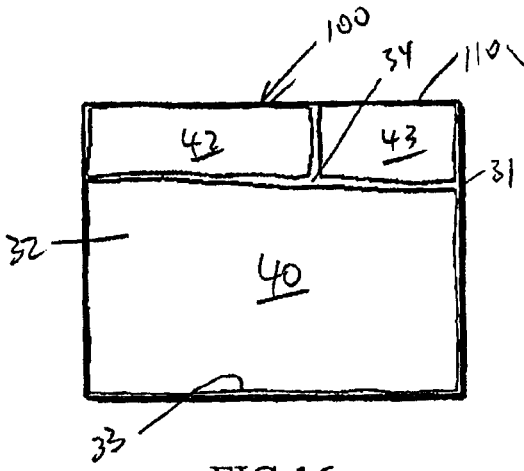
FIGS. 16*a* to 16*d* are schematic views of artificial stones with a right rectangular base portion and a top portion with a facing surface of an irregular outline fitting within the rectangular outline of the base portion.
Figure 16B:
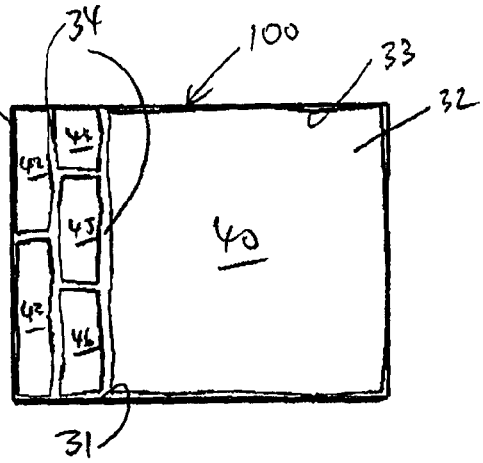
Figure 16C:
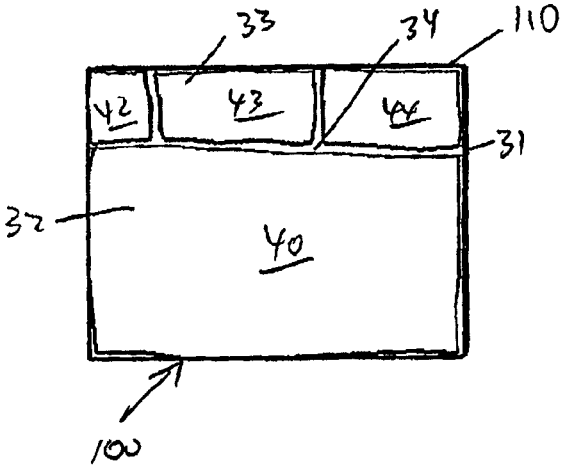
Figure 16D:
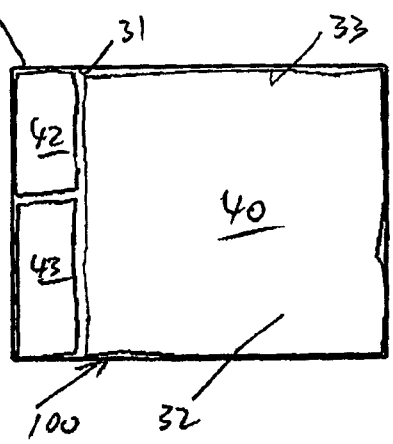

FIG. 15 shows an arrangement of artificial stones 100 in accordance with the invention resulting in a surface covering with an irregular surface, simulating the appearance of natural stone. Thanks to its particular configuration, when an artificial stone 100 according to the invention is used in combination with other like ones, for defining a surface covering, each stone 100 is matingly engageable with neighboring stones 100. The set shown in FIG. 15 includes multiple stones 100 with base portions shaped to fit together in a mating arrangement, producing a continuous surface covering. In the illustrated arrangement, each stone 100 is advantageously provided with a top face 32 having a texture that imitates a natural artificial stone, such as a natural flagstone. Due to the differing surface structures of the stones 100 and especially the combination on the surface of each stone of a major, slab like surface portion with one or more minor, filler stone like surface portions, the overall surface of the surface covering has an irregular, natural appearance.

FIGS. 16*a* to 16*d* show a set of artificial stones 100 in accordance with the invention and similar to those shown in FIGS. 12*a* to 12*d*. However, each artificial stone 100 illustrated in FIGS. 16*a* to 16*d* includes a body 110 with a rectangular body contour 31 or footprint and a facing surface 32 of a contour different from the one of the body contour, but fitting within the footprint of the body. This principle relationship between the shape of the facing surface 32 and the body was previously discussed in relation to FIGS. 1 to 8 and 14*a* to 14*i*. As with the artificial stones shown in FIGS. 12*a* to 12*d*, the facing surface 32 has a facing contour 33 and a surface area and is divided by at least one simulated joint 34 into a major surface portion 40 and one or more minor surface portions 42, 43, 44, 45, 46, preferably located at the facing facing contour 33. The major surface portion 40 is free of simulated joints 34 and extends over at least about 60% of the total facing surface and has the appearance of a slab. The minor surface portion has the appearance of a filler stone, or multiple filler stones, giving the artificial stone the overall appearance of a large, continuous slab stone combined with one or more filler stones.

The facing surface 32 preferably has an irregular, but overall substantially rectangular facing facing contour 33. The simulated joints 34 are preferably positioned to divide off one or more points or corners of the polygonal facing surface 32. When more than one simulated joint 34 is provided, each joint can be positioned to divide off a separate minor portion 42, 43, respectively located at different corners, sides or points of the facing surface. Alternatively, one simulated joint 34 can be used to divide off a minor portion 42 along one side of the facing surface 32 and one or more additional simulated joints 34 can be used to subdivide this minor portion 42 into multiple minor portions 43, 44, 45. It is also within the confines of the invention to subdivide the minor portion 42 into multiple sub-portions (43, 44, 45) by a plurality of simulated joints 34, whereby one or more of the sub-portions are no longer located at the facing facing contour 33 (see FIG. 16*b*).

Figure 17:
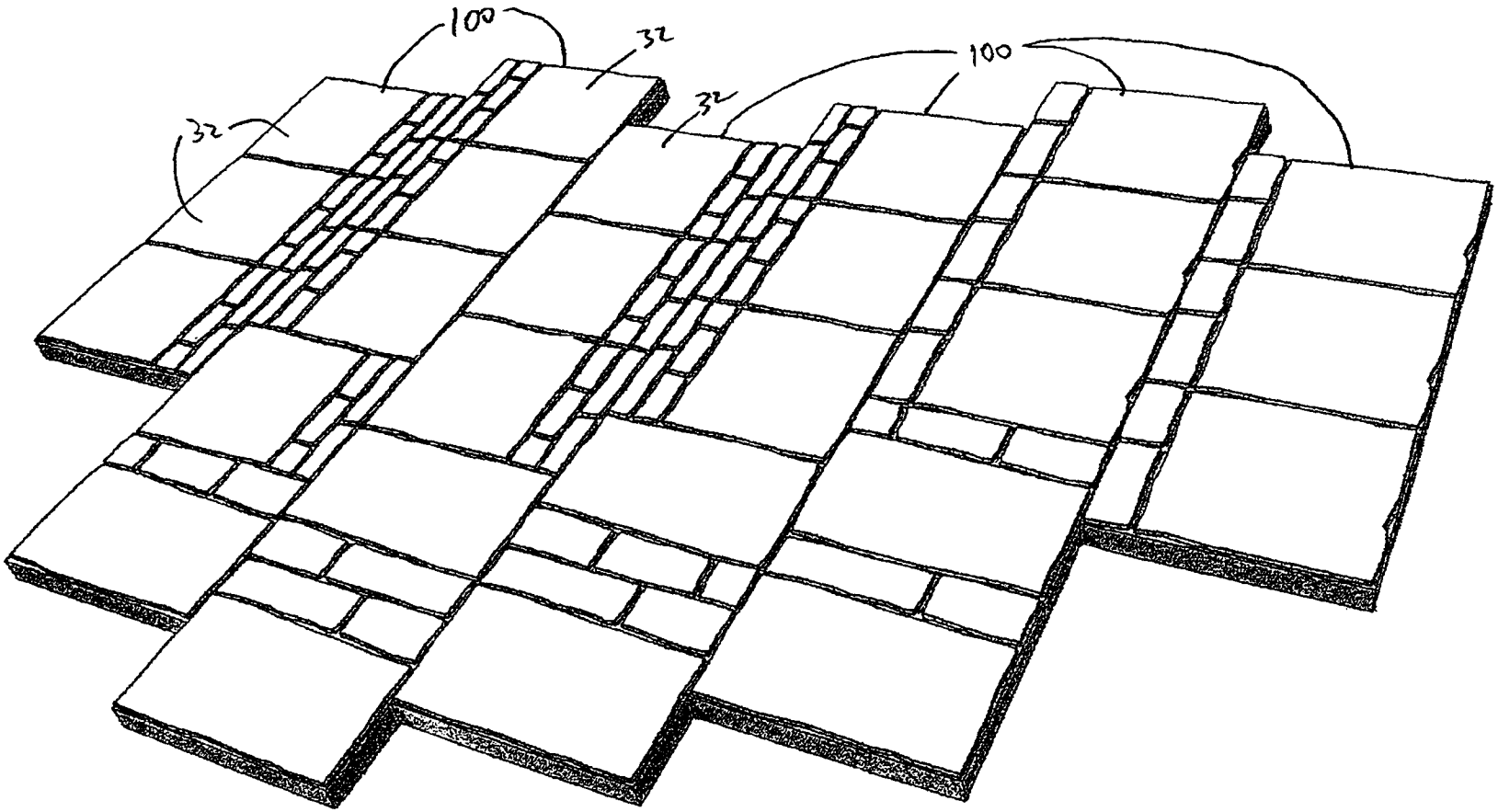
FIG. 17 is a simulated perspective view of a surface covering arrangement using artificial stones as shown in FIGS. 16*a* to 16*d;*
Figure 19:
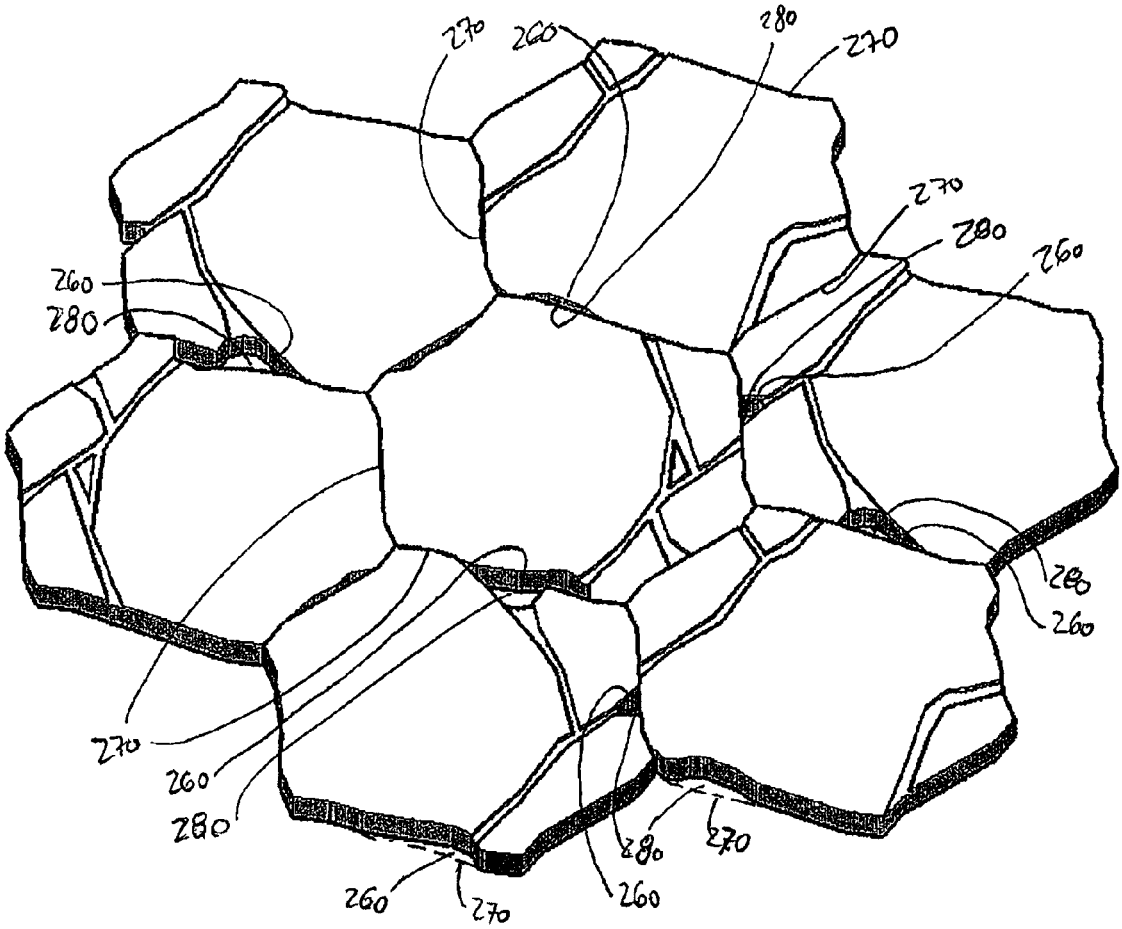
FIG. 19 is a simulated perspective view of a surface covering arrangement using artificial stones as shown in FIGS. 18*d* to 18*f*, illustrating the gaps between the mating stones created by the perimeter recesses.
Figure 21:
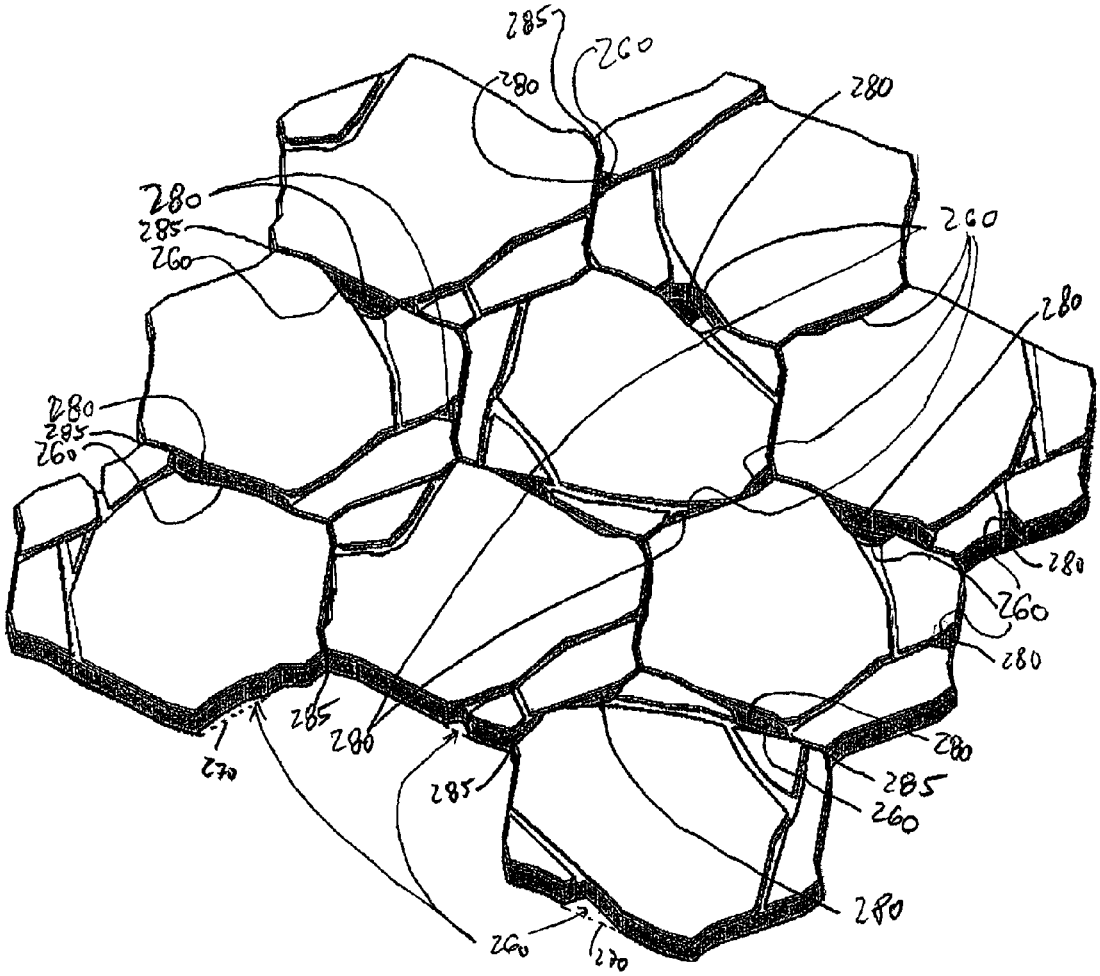
FIG. 21 is a simulated perspective view of a surface covering arrangement using artificial stones as shown in FIGS. 20*e* to 20*h*, illustrating the gaps between the mating stones created by the perimeter recesses.

FIG. 17 shows an arrangement of artificial stones 100 in accordance with the invention resulting in a surface covering with an irregular surface, simulating the appearance of natural stone. Thanks to its particular configuration, when an artificial stone 100 according to the invention is used in combination with other like ones, for defining a surface covering, each stone 100 is matingly engageable with neighboring stones 100. The set shown in FIG. 17 includes multiple stones 100 with base portions shaped to fit together in a mating arrangement, producing a continuous surface covering. In the illustrated arrangement, each stone 100 is advantageously provided with a top surface 32 having a texture that imitates a natural artificial stone, such as a natural flagstone. Due to the differing surface structures of the stones 100 and especially the combination on the surface of each stone of a major, slab like surface portion with one or more minor, filler stone like surface portions, the overall surface of the surface covering has an irregular, natural appearance.

In a particularly preferred embodiment, as illustrated in FIGS. 18 to 22, the invention provides an artificial stone 200 including a polygonal base portion 210 of a preselected body contour or footprint 270 which allows for mating engagement along the perimeter of the stone in a repeated pattern with other like stones. The preselected body contour 270 of the base portion 210 is selected such that the stones when arranged in mating engagement are closely spaced along their perimeter to adjacent stones with intermediate perimeter joints between the stones. Apart from the base portion 210, the stones of FIGS. 18 to 22 include a facing surface 232 having a natural appearance and a facing contour 233 with a depending sidewall 211. The facing surface 232 has a surface area and is divided by at least one simulated joint 34 into a major surface portion 40 and one or more minor surface portions 42, 43, 44, 45 located at the contour 233.

The preselected body contour 270 or footprint of the artificial stones of FIGS. 18*a* to 18*f* is similar to the one of the stones shown in FIGS. 1 to 11, 14 and 15. However, as is apparent from a comparison of the stones shown in FIGS. 18*a* to 18*c* (which are identical to those of FIGS. 9*b*, 9*f* and 9*e*) with those of FIGS. 18*d* to 18*f*, the artificial stones in FIGS. 18*d* to 18*f* are additionally provided with one or more perimeter recess, cut-way or setback 260. Each perimeter recess 260 extends into the body of the stone 200 and represents a region along the perimeter of the artificial stone 200 at which the outer edge or sidewall 211 of the stone is set back from the preselected body contour or footprint 270 of the base portion 210. In FIGS. 18*d* to 18*f*, the preselected body contour is shown as a broken line in the regions of the perimeter recess 260. Each perimeter recess 260 creates the appearance of a portion of the outer edge or sidewall 11 having been cut or broken away or the stone having peripheral shape imperfections. In other words, artificial stones 200 in accordance with the invention as shown in FIGS. 18*d* to 18*f* have regions along their perimeter where the outer edge or sidewall 11 of the artificial stone is set back from the preselected body contour or footprint 270 so that exact mating engagement of the stone 200 with a like stone is no longer possible in those regions, since the perimeter recess 260 results in a gap 280 between the adjoining individual stones, as is apparent from FIG. 19. The gaps 280 significantly enhance the natural appearance of a repeated pattern of the artificial stones 200, since the gaps provide a break in the perimeter joints and visually break the pattern of juncture lines between the stones, the perimeter joints, especially when all perimeter joints 285 (see FIG. 21) between the stones 200, the simulated joints 34 and the gaps 280 are filled with sand, grout or the like to complete the installation of the stones. Each gap 280 is wider than the adjoining perimeter joint 285.

Preferably, the peripheral recesses 260 extend over the full height of the artificial stone 200 as shown in FIGS. 18*d* to 18*f*, to enhance the natural appearance of the stone. Although it is also possible to provide the peripheral recesses 260 over only a part of the height of the artificial stone 200, they preferably extend to a sufficient depth from the facing surface 232 to prevent exposure of the base portion 210 of the stone 200 should some of the fill material in the gaps 280 (sand, grout or the like) be washed out or otherwise lost.

FIGS. 20*a* to 20*h* show a set of artificial stones 200 in accordance with the invention and similar to those shown in FIGS. 18*a* to 18*f*. However, each artificial stone 200 illustrated in FIGS. 20*a* to 20*h* includes a base portion 210 with a polygonal body contour 270, or footprint, and a facing surface 232 of a polygonal facing contour 233 different from the one of the base portion 210, but fitting within the body contour or footprint 270. This principle relationship between the shape of the facing surface 232 and the shape of the body and its footprint was previously discussed in relation to FIGS. 1 to 8 and 14*a* to 14*i*. As with the artificial stones shown in FIGS. 18*a* to 18*f*, the facing surface 232 has a contour 233 and a surface area and is divided by at least one simulated joint 34 into a major surface portion 40 and one or more minor surface portions 42, 43, 44, 45 located at the facing contour 233.

Similar to the stones of FIGS. 18*d* to 18*f*, the artificial stones 200 of FIGS. 20*e* to 20*h* are respectively provided with one or more perimeter recess or setback 260. Each perimeter recess 260 represents a region along the perimeter of the artificial stone 200 at which the outer edge or sidewall 211 of the stone is set back from the preselected body contour 270 of the base portion 210. As in FIGS. 18*d* to 18*f*, the preselected body contour 270 is shown in FIGS. 20*e* to 20*h* as a broken line in the regions of the perimeter recesses 260. This results in gaps 280 between the individual stones at the location of the perimeter recesses 260, when the stones 200 are arranged side-by-side, as is apparent from FIGS. 21 and 22. The gaps 280 which significantly enhance the natural appearance of a repeated pattern of the artificial stones 200, as is clearly apparent from FIG. 22. When the perimeter joints 285 (see FIG. 21) between the stones 200, the simulated joints 34 and the gaps 280 are filled with sand, grout or the like to complete the installation of the stones, the filled gaps visually break the pattern of juncture lines between the stones, which surprisingly results in a very natural overall appearance of the installed stones, despite the stones all having the same preselected contour and being arranged in a repeated pattern.

Figure 22:
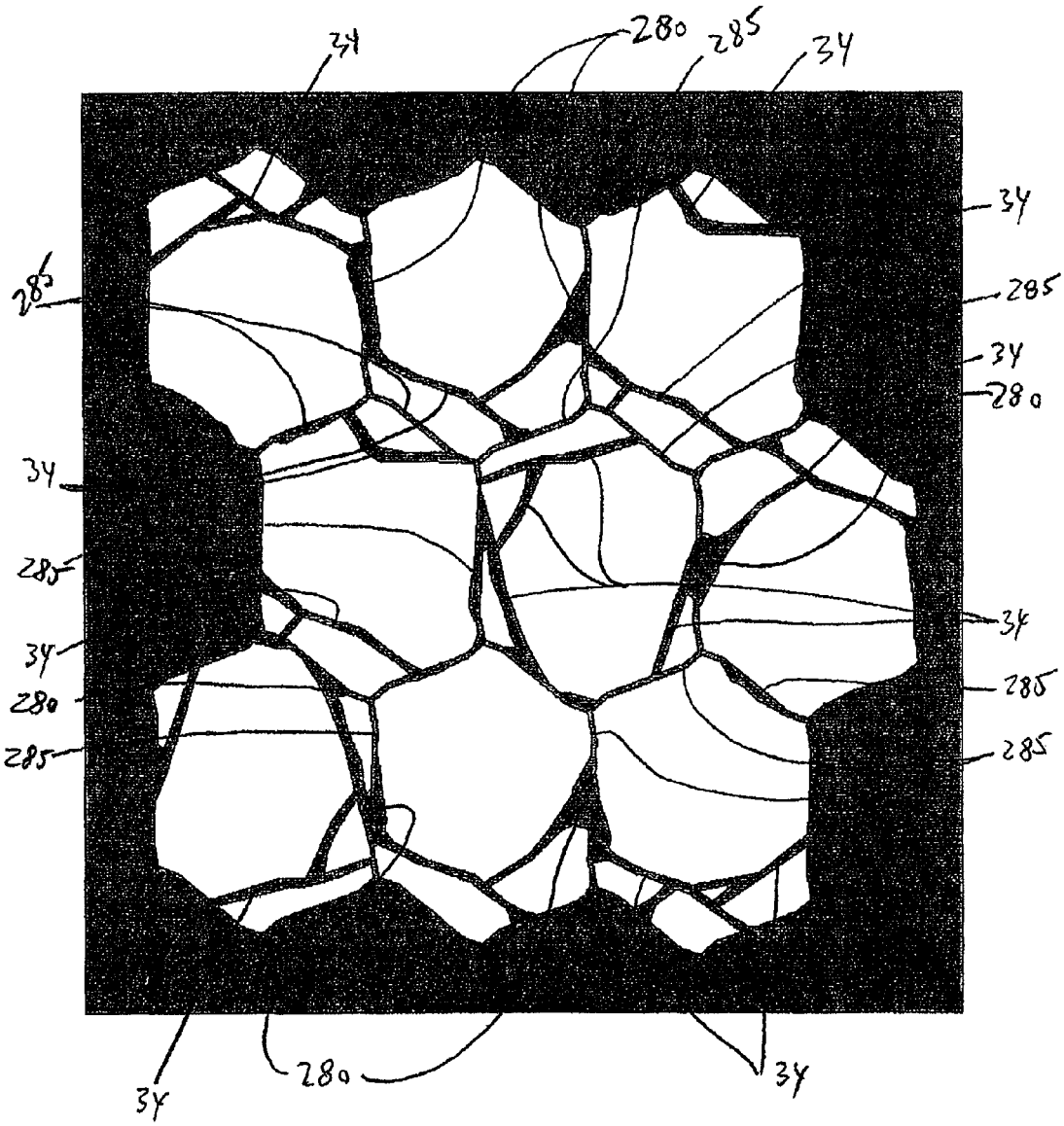
FIG. 22 is a simulated top view of the surface covering arrangement of FIG. 21.
Figures 23A, 23B, 23C, 23D, 23E, 23F, 23G, 23H:
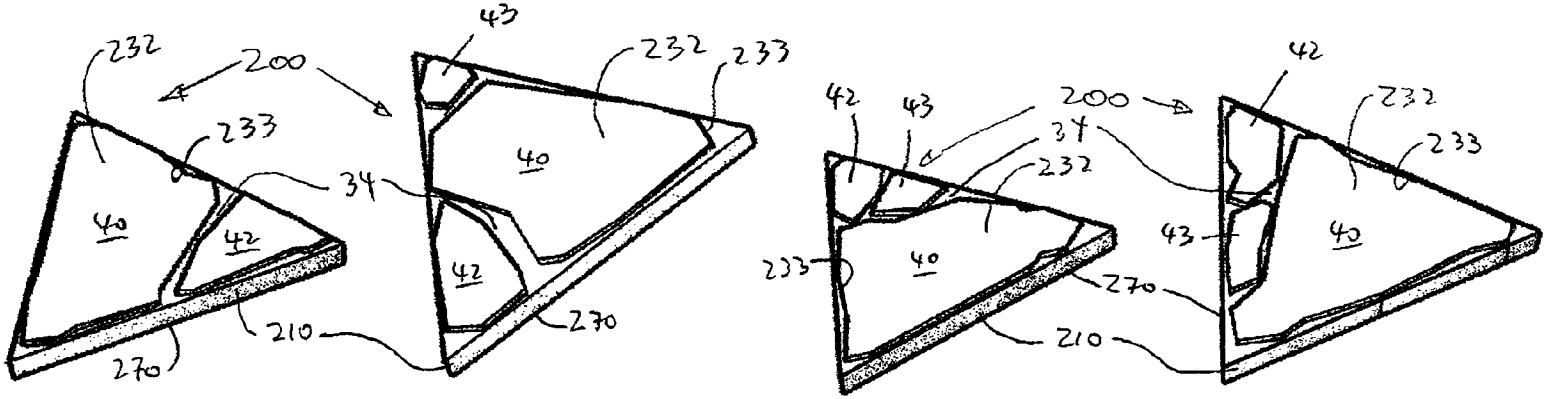
FIGS. 23*a* to 23*d* are schematic isometric views of artificial stones with a right triangular base portion and a top portion with a facing surface of an irregular outline fitting within the triangular footprint of the base portion and FIGS. 23*e* to 23*h* show the same stones, but having at least one perimeter recess.

FIG. 22 simulates the appearance of a regular pattern of the stones 200 from FIGS. 20*e* to 20*h* with the fill material in the perimeter joints 285, simulated joints 34 and gaps 280 being shown in grey. The resulting overall appearance is very natural and emulates a combination of large, slab like stones of irregular shape with small filler stones of irregular shape.

FIGS. 23*a* to 23*h* show a set of artificial stones 200 in accordance with the invention and similar to those shown in FIGS. 18*a* to 18*f*. However, each artificial stone 200 illustrated in FIGS. 23*a* to 23*h* includes a base portion 210 with a triagonal body contour 270, or footprint, and a facing surface 232 of a polygonal facing contour 233 different from the one of the base portion 210, but fitting within the body contour or footprint 270. This principle relationship between the shape of the facing surface 232 and the shape of the body and its footprint was previously discussed in relation to FIGS. 1 to 8 and 14*a* to 14*i*. As with the artificial stones shown in FIGS. 18*a* to 18*f*, the facing surface 232 has a facing contour 233 and a surface area and is divided by at least one simulated joint 34 into a major surface portion 40 and one or more minor surface portions 42, 43, 44, 45 located at the facing contour 233. Similar to the stones of FIGS. 18*d* to 18*f*, the artificial stones 200 of FIGS. 23*e* to 23*h* are respectively provided with one or more perimeter recess or setback 260. Each perimeter recess 260 represents a region along the perimeter of the artificial stone 200 at which the outer edge or sidewall 211 of the stone is set back from the preselected body contour 270 of the base portion 210. As in FIGS. 18*d* to 18*f*, the preselected body contour or footprint 270 is shown in FIGS. 23*e* to 23*h* as a broken line in the regions of the perimeter recesses 260. This results in gaps 280 between the individual stones at the location of the perimeter recesses 260, when the stones 200 are arranged side-by-side, as is apparent from FIG. 24. The gaps 280 which significantly enhance the natural appearance of a repeated pattern of the artificial stones 200, as is clearly apparent from FIG. 24. When the perimeter joints 285 between the stones 200, the simulated joints 34 and the gaps 280 are filled with sand, grout or the like to complete the installation of the stones, the filled gaps visually break the pattern of juncture lines or perimeter joints between the stones, which surprisingly results in a very natural overall appearance of the installed stones, despite the stones all having the same preselected contour and being arranged in a repeated pattern.

Figure 24:
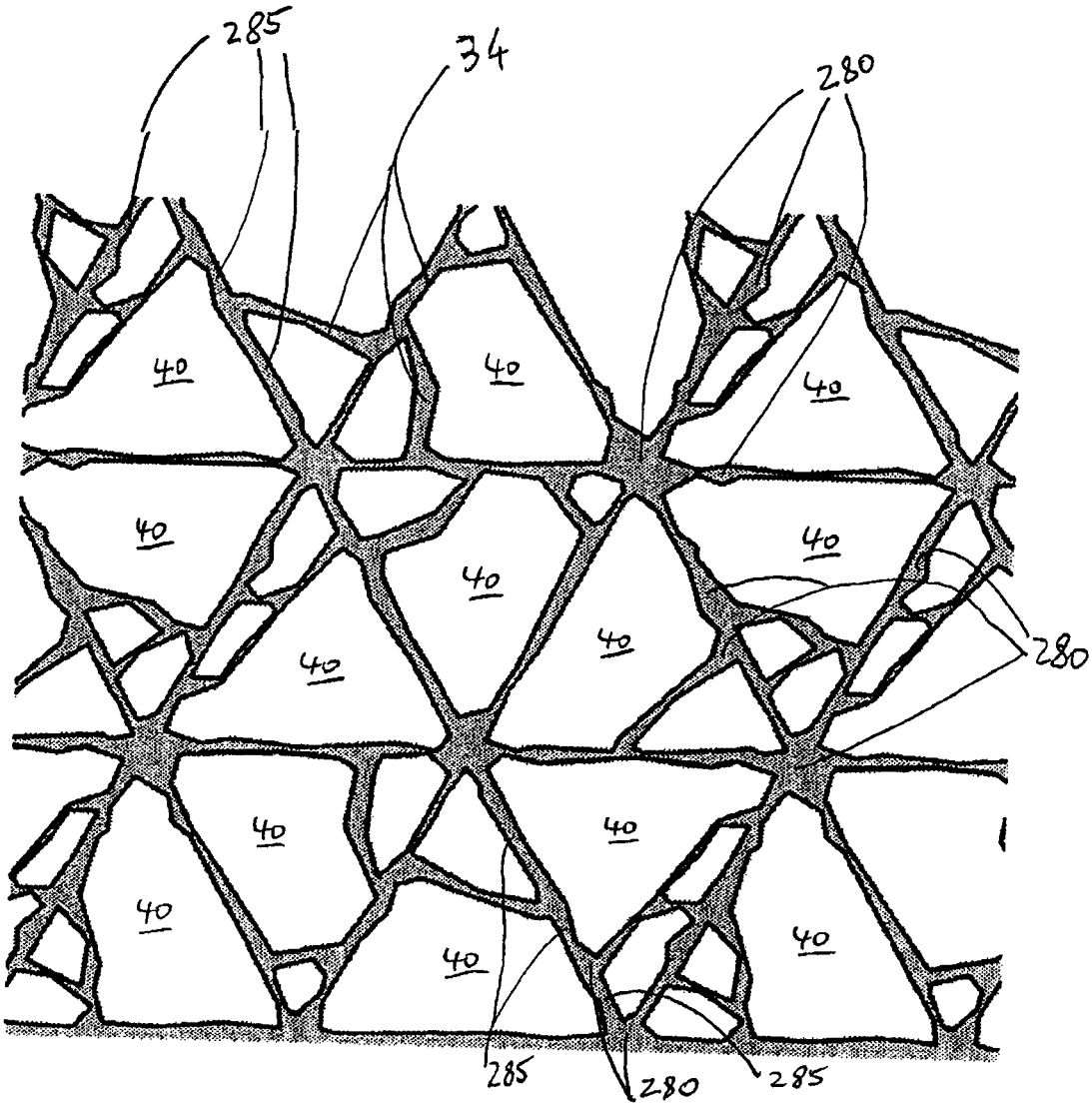
FIG. 24 is a simulated top view of a surface covering arrangement using artificial stones as shown in FIGS. 23*e* to 23*h*, illustrating the gaps between the mating stones created by the perimeter recesses.

FIG. 24 simulates the appearance of a regular pattern of the stones 200 from FIGS. 23*e* to 23*h* with the fill material in the perimeter joints 285, simulated joints 34 and gaps 280 being shown in grey. The resulting overall appearance is very natural and emulates a combination of large, slab like stones of irregular shape with small filler stones of irregular shape.

Figure 25B:
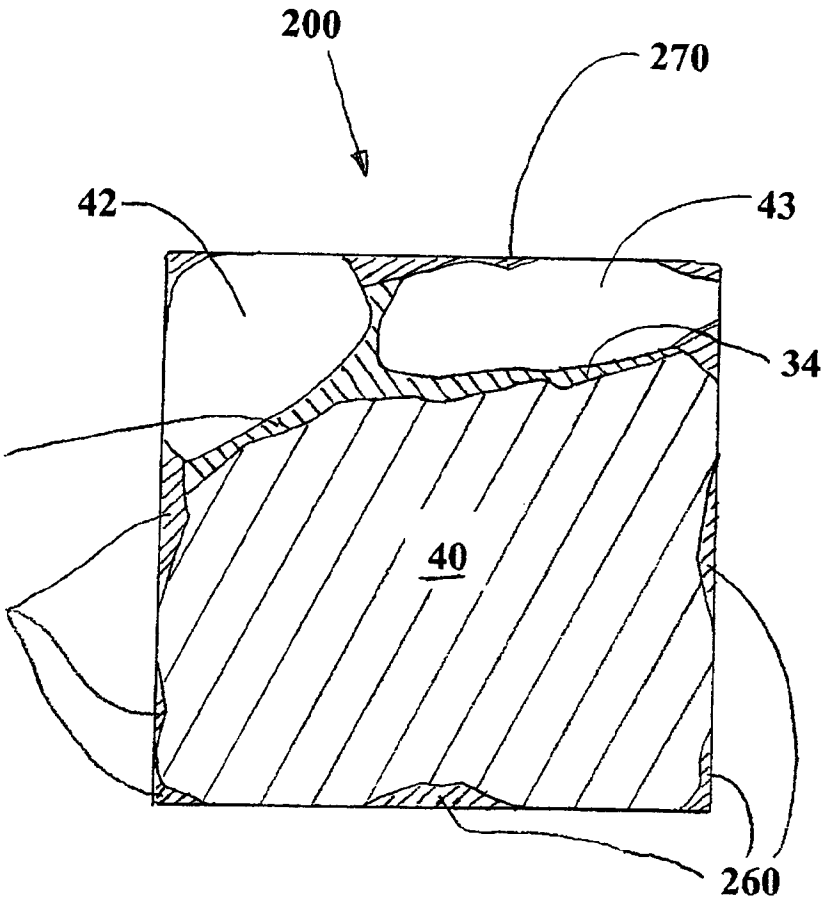
FIGS. 25*a* and 25*b* are schematic illustrations of artificial stones in accordance with the invention with hexagonal and rectangular footprint, respectively and illustrating the areas of the footprint covered by the major surface portion, the minor surface portion, the simulated joints an the perimeter recesses.
Figure 25A:
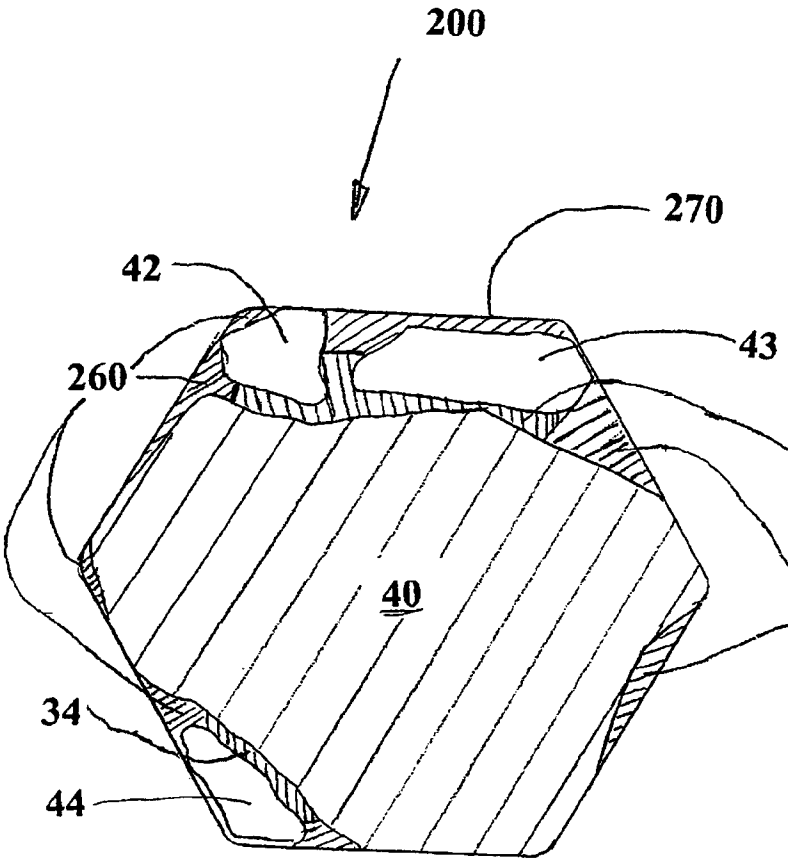

FIGS. 25*a* and 25*b* schematically illustrate artificial stones 200 in accordance with the invention with hexagonal and square footprint 270 respectively. The areas of the footprint covered by the major surface portion 40, the minor surface portions 42, 43, 44, the simulated joints 34 and the perimeter recesses 260 are respectively identified. It is preferred that, as is apparent from FIGS. 18*d*-18*f*, 20*e*-20*h* and 23*e*-23*h*, the major surface portion 40 covers preferably at least about 70% of the footprint 270, the minor surface portions 42, 43, 44 cover preferably at least about 15% of the footprint, the simulated joints 34 preferably cover at most 5% of the footprint and the perimeter recesses 260 preferably cover at most about 10% of the footprint.

In another aspect, the invention provides a set of artificial stones, wherein the top surface texture of each stone in the set is different from the top surface texture of every other stone in the set. Such a set of stones preferably includes all the stones made within a multi-cavity dry casting frame, whereby each cavity produces one stone with a facing surface that is unique within the set. The base portions of the stones in the set preferably have a polygonal cross-section and are shaped as a right prism so that the base portions fit together in a mating arrangement of the flagstones in the set and flagstones of other like sets.

In a preferred method in accordance with the invention, the set of artificial stones is made in a dry casting operation using a multi-cavity mold having a tamper shoe with a differently shaped compression surface for each cavity in the mold to produce a different surface texture for the artificial stone made in each cavity. The method preferably includes the steps of providing a multi-cavity dry casting frame, each mold cavity of the dry casting frame having sidewalls for shaping the body of the artificial stone, at least one division plate in the dry casting frame separating adjacent cavities having a protrusion for extending into one cavity and forming a perimeter recess in a sidewall of the dry cast stone made in the cavity, placing the multi-cavity dry casting frame on a press support, filling the mold cavity with a dry cast concrete mixture and compressing the dry cast concrete mixture with the tamper shoe having a different surface structure for each mold cavity, stripping the compressed pre-product from the mold cavity, and curing the stripped pre-product to form the set of artificial stones. In a preferred embodiment, the method includes the step of replacing the division plate in the dry casting frame having the protrusion with a division plate having one or more different protrusions to form one or more different perimeter recesses in the dry cast artificial stones.

From the above, it can easily be understood that the artificial stone according to the present invention can advantageously be used for creating patios, pathways, sidewalks or stepping stones for non-limitative examples. Moreover, the artificial stone of the present invention can advantageously be easily laid out to form a pavement or a wall surface where no straight lines and hardly any repetition can be seen, giving as a result, the look of old world craftsmanship, replicating the complexity of a natural stone assembly.

Furthermore, it will be appreciated that all of the artificial stone of a pavement can be the same, but still create a visually "random" effect in which no straight lines can be seen.

The artificial stone according to the present invention has several advantages over prior art products. Indeed, its installation is very easy, does not require distinctive markers for guiding the installation, and does not require professional skills. The resulting pavement has no "linear effect", that is, a person walking thereon would not see any straight line in front of him or her. It has a random look, achieved with a single stone design.

While the invention has been described with a certain degree of particularity, it is understood that the invention is not limited to the embodiments set forth herein for purposes of exemplification, but is to be limited only by the scope of the attached claims, including the full range of equivalency to which each element thereof is entitled.

Although the present invention has been explained hereinabove by way of preferred embodiments thereof, it should be pointed out that any modifications to these preferred embodiments within the scope of the appended claims are not deemed to alter or change the nature and scope of the present invention.

The invention claimed is:

1. An artificial stone for covering a supporting surface, comprising:

a base portion having a base surface forming a lowermost surface of the base portion for placement on the supporting surface, the base portion having a body shape with a body contour for mating engagement of the artificial stone with other like stones in a repeating pattern with intermediate perimeter joints;

a top portion positioned above the base portion and having a facing surface forming an uppermost surface of the top portion, the facing surface having a total surface area defined by an irregular facing contour and being subdivided by at least one simulated joint into a continuous, major surface portion and at least one minor surface portion; the major surface portion being free of any simulated joints and having an appearance of a slab and the at least one minor surface portion having an appearance of a filler stone, wherein the at least one simulated joint extends from the facing surface, through at least a portion of the top portion, and without extending into the base portion; and at least one perimeter recess extending from the facing surface, through the top portion, and through at least a portion of the base portion for generating a gap between the artificial stone and another like artificial stone in mating engagement therewith, the gap having a larger width than an adjoining perimeter joint.

2. The artificial stone of claim 1, wherein the at least one perimeter recess extends from the facing surface to the base surface.

3. The artificial stone of claim 1, comprising at least two perimeter recesses.

4. The artificial stone of claim 1, wherein the facing surface has at least one irregularly shaped protrusion or depression for giving the top portion an appearance of natural stone.

5. The artificial stone of claim 1, wherein the facing surface has at least one irregularly shaped protrusion and at least one irregularly shaped depression.

6. The artificial stone of claim 1, wherein the facing surface includes at least two simulated joints and at least two minor surface portions located at the facing contour.

7. The artificial stone of claim 6, wherein the at least two minor surface portions are adjacent to one another.

8. The artificial stone of claim 1, wherein the facing surface includes at least three minor surface portions, one minor surface portion being spaced from the facing contour.

9. The artificial stone of claim 6, wherein the at least two minor surface portions are positioned spaced apart along the facing contour.

10. The artificial stone of claim 1, wherein the major surface portion extends over at least about 60% of the total surface area.

11. The artificial stone of claim 1, wherein the facing contour fits into the body contour.

12. The artificial stone of claim 1, wherein the minor surface portion extends over at most about 30% of the total surface area and is free of simulated joints.

13. The artificial stone of claim 12, wherein the at least one simulated joint covers at most about 5% of the total surface area.

14. The artificial stone of claim 1, wherein the artificial stone is a dry cast concrete stone.

15. The artificial stone of claim 1, wherein the the facing contour fits within the body contour.

16. The artificial stone of claim 15, wherein the artificial stone further comprises an intermediate portion between the top and base portions, the intermediate portion having an inclined wall connecting the top portion with a sidewall of the base portion.

17. The artificial stone of claim 1, shaped and constructed as a wall veneer stone, a wall tile, or a paving stone, preferably made of dry concrete.

18. The artificial stone of claim 17, wherein the at least one perimeter recess is formed by a division plate of a mold used during a dry casting process.

19. The artificial stone of claim 1, wherein the facing surface has at least two irregularly shaped areas of respectively different elevation.

20. A set of artificial stones, comprising at least two artificial stones as defined in claim 1, an appearance of the facing surface of one artificial stone in the set being different from the appearance of the facing surface of every other artificial stone in the set.

21. The set of artificial stones as defined in claim 20, wherein all artificial stones in the set have the same body shape when the at least one perimeter recess is not included with each artificial stone.

22. The set of artificial stones as defined in claim 20, wherein each artificial stone has a hexagonal body contour.

23. The set of artificial stones as defined in claim 20, wherein each artificial stone has a rectangular body contour.

24. The set of artificial stones as defined in claim 20, wherein each artificial stone has a triangular body contour.

* * * * *

UNITED STATES PATENT AND TRADEMARK OFFICE

CERTIFICATE OF CORRECTION

PATENT NO. : 8,413,397 B2
APPLICATION NO. : 12/993526
DATED : April 9, 2013
INVENTOR(S) : Marc-Andre Lacas, Bertin Castonguay and Robert Daoust It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 64 days.

Signed and Sealed this
Thirtieth Day of July, 2013

Teresa Stanek Rea
*Acting Director of the United States Patent and Trademark Office*